US006776589B2

(12) United States Patent
Tomell et al.

(10) Patent No.: US 6,776,589 B2
(45) Date of Patent: Aug. 17, 2004

(54) RECIPROCATING PISTON COMPRESSOR HAVING IMPROVED NOISE ATTENUATION

(75) Inventors: Phillip A. Tomell, Adrian, MI (US); Ronny A. Shafer, Adrian, MI (US); Anil Gopinathan, Saline, MI (US); Andrew W. Paczuski, Adrian, MI (US); Michael A. DiFlora, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/350,410

(22) Filed: Jan. 24, 2003

(65) Prior Publication Data

US 2003/0156955 A1 Aug. 21, 2003

Related U.S. Application Data

(62) Division of application No. 09/994,236, filed on Nov. 27, 2001, now Pat. No. 6,558,137.

(60) Provisional application No. 60/250,709, filed on Dec. 1, 2000.

(51) Int. Cl.[7] ..... F04B 17/00; F04B 35/04

(52) U.S. Cl. ..... 417/415; 417/269; 417/271; 417/559

(58) Field of Search ..... 417/415, 269, 417/271, 559

(56) References Cited

U.S. PATENT DOCUMENTS

| | | | | |
|---|---|---|---|---|
| 2,274,459 A | | 2/1942 | Rauen | 181/59 |
| 2,437,446 A | | 3/1948 | Stephens | 181/48 |
| 3,006,160 A | | 10/1961 | Heidorn | 62/296 |
| 3,114,754 A | | 12/1963 | Tilden | 62/5 |
| 3,233,698 A | | 2/1966 | Powers | 181/48 |
| 3,323,305 A | | 6/1967 | Klees | 60/52 |
| 3,645,358 A | | 2/1972 | Kubota et al. | 181/36 |
| 3,913,703 A | | 10/1975 | Parker | 181/44 |
| 3,920,095 A | | 11/1975 | Clark | 181/42 |
| 4,061,444 A | | 12/1977 | Dirk et al. | 417/312 |
| 4,086,032 A | | 4/1978 | Nishioka et al. | 417/363 |
| 4,105,227 A | | 8/1978 | Ekberg et al. | 285/412 |
| 4,356,885 A | | 11/1982 | Dello | 181/227 |
| 4,418,443 A | | 12/1983 | Fischer | 15/326 |
| 4,431,383 A | * | 2/1984 | Boehmler et al. | 417/312 |
| 4,559,686 A | * | 12/1985 | Kessler | 29/888.025 |
| 4,671,380 A | | 6/1987 | Henderson et al. | 181/233 |
| 4,676,515 A | | 6/1987 | Cobb | 277/235 |
| 4,745,988 A | | 5/1988 | Hardt et al. | 181/249 |
| 4,758,135 A | | 7/1988 | Woodward et al. | 417/559 |
| 4,782,858 A | | 11/1988 | Fujiwara | 137/571 |
| 4,846,482 A | | 7/1989 | Blodgett et al. | 277/235 |
| 4,854,839 A | | 8/1989 | DiFlora | 417/571 |

(List continued on next page.)

*Primary Examiner*—Justine R. Yu
*Assistant Examiner*—William H. Rodriguez
(74) *Attorney, Agent, or Firm*—Baker & Daniels

(57) ABSTRACT

A reciprocating piston compressor having a suction muffler and a pair of discharge mufflers to attenuate noise created by the primary pumping frequency in the primary pumping pulse. The suction muffler is disposed along a suction tube extending between the motor cap and the cylinder head of the compressor. The discharge mufflers are positioned in series within the compressor to receive discharge gases from the compression mechanism and are spaced one quarter of a wavelength from each other so as to sequentially diminish the problematic or noisy frequencies created during compressor operation. The motor/compressor assembly including the motor and compression mechanism is mounted to the interior surface of the compressor housing by spring mounts. These mounted are secured to the housing to define the position of the nodes and anti-nodes of the frequency created in the housing to reduce noise produced by natural frequencies during compressor operation.

9 Claims, 18 Drawing Sheets

U.S. PATENT DOCUMENTS 4,901,760 A 2/1990 Nagashima ..... 137/514
4,930,995 A * 6/1990 Suzuki et al. ..... 417/312
4,979,587 A 12/1990 Hirt et al. ..... 181/213
5,051,069 A * 9/1991 Ikeda et al. ..... 417/269
5,101,931 A 4/1992 Blass et al. ..... 181/240
5,129,793 A 7/1992 Blass et al. ..... 417/312
5,199,856 A 4/1993 Epstein et al. ..... 417/312
5,201,643 A 4/1993 Hirosawa et al. ..... 417/472
5,205,719 A 4/1993 Childs et al. ..... 417/312
5,214,937 A 6/1993 Henrichs et al. ..... 62/468
5,224,840 A 7/1993 Dreiman et al. ..... 417/312
5,226,796 A 7/1993 Okamoto et al. ..... 417/571
5,238,370 A 8/1993 DiFlora ..... 417/312
5,265,646 A 11/1993 Richardson ..... 137/856
5,277,552 A * 1/1994 Higuchi ..... 417/222.2
5,281,110 A * 1/1994 Dreiman ..... 417/415
5,288,212 A 2/1994 Lee ..... 417/312
5,341,654 A 8/1994 Hewette et al. ..... 62/296
5,483,867 A * 1/1996 Ikeda et al. ..... 92/71
5,493,080 A 2/1996 Moss ..... 181/232
5,495,711 A 3/1996 Kalkman et al. ..... 60/469
5,583,325 A 12/1996 Schutte et al. ..... 181/237
5,584,674 A 12/1996 Mo ..... 417/312
5,596,879 A 1/1997 Burkhart et al. ..... 62/296
5,635,687 A 6/1997 Biscaldi ..... 181/272
5,638,736 A * 6/1997 Murakami et al. ..... 92/71
5,697,216 A 12/1997 Phillips ..... 60/469
5,702,236 A * 12/1997 Ikeda ..... 417/269
5,723,828 A 3/1998 Nakagawa ..... 181/250
5,762,479 A 6/1998 Baars et al. ..... 417/312
5,785,508 A 7/1998 Bolt ..... 417/560
5,899,218 A 5/1999 Dugan ..... 137/1
5,951,261 A 9/1999 Paczuski ..... 417/315
5,957,664 A 9/1999 Stolz et al. ..... 417/53
5,996,733 A 12/1999 DeTuncq et al. ..... 181/250
6,135,727 A * 10/2000 Dreiman et al. ..... 417/415
6,398,515 B1 * 6/2002 Yokomachi et al. ..... 417/201
6,511,296 B2 * 1/2003 Ota et al. ..... 417/222.2
6,532,859 B1 * 3/2003 Kuhn et al. ..... 92/71

* cited by examiner

A
B
A1
A2
A3
D
D'
λ
182
184
186
188
190
96
156
158
170E
180A

RECIPROCATING PISTON COMPRESSOR HAVING IMPROVED NOISE ATTENUATION

CROSS REFERENCE TO RELATED APPLICATION

This application is a division of application Ser. No. 09/994,236, filed Nov. 27, 2001, (now U.S. Pat. No. 6,558,137) which claims the benefit under 35 U.S.C. §119(e) U.S. Provisional Patent Application Serial No. 60/250,709, filed Dec. 1, 2000.

BACKGROUND OF THE INVENTION

The present invention relates to reciprocating piston fluid compression devices such as hermetic refrigerant compressors, particularly with regard to quieting same.

Fluid compression devices such as, for example, refrigerant compressors, receive a gas at a suction pressure and compress it to a relatively higher, discharge pressure. Depending on the type of compression device, the work exerted on the gas in compressing it is characterized by a series of intermittently exerted forces on the gas, the magnitude of these forces normally varying from zero to some maximum value. For example, in a cylinder of a reciprocating piston type compressor, this force ranges from zero at the piston's bottom dead center (BDC) position, to a maximum at or near the piston's top dead center (TDC) position, at which the pressure of the compressed gas is respectively at a minimum pressure (i.e., substantially suction pressure) and a maximum pressure (i.e., substantially discharge pressure). Some quantity of the gas is discharged from the cylinder as the piston assumes new positions as it advances from BDC to TDC, and thus the compressed gas flowing from the cylinder is not at a uniform pressure. Rather, the gas which flows from the cylinder, which is generally referred to as being at discharge pressure, actually has many different pressures.

Pulses of higher discharge pressure result in the compressed gas flowing from the cylinder, these pulses being in the portion of the flowing gas which leaves the cylinder as the piston approaches or reaches TDC. As the piston cycles in its cylinder, regular, equally distributed patterns of these pulses are created in the compressed gas which flows through a conduit, tube or line leading from the compression mechanism. The pulsating flow of compressed gas through this discharge line may be represented by sine waves of various frequencies and having amplitudes which may vary with changes in the quality of the refrigerant; these changes are effected by changes in refrigerant type, temperature or pressure. Pulsations at certain frequencies may be more noticeable, and thus more objectionable, than others.

Further, the nominal discharge pressure, i.e., the pressure at which the compressed gas is generally considered to be, will also vary with refrigerant quality. The frequency of these high pressure pulses in the compressed gas flowing through the discharge line, however, has a substantially constant frequency which directly correlates to the speed at which the gas is compressed in the cylinder, and the number of cylinders in operation. This frequency is referred to as the primary pumping frequency, and is generally the lowest frequency exhibited by the pressure pulsations in the compressed gas.

The amplitude of the pressure pulses at the primary pumping frequency tend to be the largest in the compressed gas flow. Because the primary pumping pulses are at low frequencies and large amplitudes, they are often the primary cause of objectionable noise or vibration characteristics in compressors or the refrigeration systems into which these compressors are incorporated. These systems normally also include at least two heat exchangers, a refrigerant expansion device, and associated refrigerant lines which link these components into a closed loop relationship. Pressure pulsations at other, higher frequencies have amplitudes which are relatively smaller, but certain of these pressure pulsations may also be objectionable. Further, some objectionable pressure pulsations may establish themselves in the conduits or lines which convey refrigerant substantially at suction pressure to the compression mechanism.

Substantial effort has been expended in attempting to quiet these pressure pulses in addressing noise or vibration concerns, and it is known to provide mufflers in the discharge or suction lines to help resolve these issues. These mufflers may be of the expansion chamber type, in which a first refrigerant line portion opens directly into a chamber, wherein the amplitude and/or frequency of at least one of the pulses may be altered, and from which the refrigerant exits through a second line portion. Further, it is known that the discharge chamber in the head of a reciprocating piston compressor can also serve as a type of expansion chamber muffler. An expansion chamber type muffler of any type is not entirely satisfactory, however, for it may cause a substantial pressure drop in the gas as it flows therethrough, resulting in compressor inefficiency. Further, such mufflers may not provide sufficient attenuation required by the application.

An alternative to an expansion chamber type of muffler is what is well known in the art as a Helmholtz resonator type of muffler wherein the wall of a portion of the discharge pressure line may be provided with a plurality of holes, that portion of the discharge line is sealably connected to a shell which defines a resonance chamber, the holes in the discharge line providing fluid communication between the interior of the discharge line and the resonance chamber. The size and/or quantity and/or axial spacing of these holes, and the volume of the resonance chamber, are variably sized to tune a Helmholtz resonator to a particular frequency, and the amplitude of pulses at that frequency are thereby attenuated. Compared to an expansion chamber type of muffler, a Helmholtz muffler provides the advantage of not causing so significant a pressure drop in the fluid flowing therethrough; thus compressor efficiency is not compromised to the same degree.

Although a Helmholtz resonator may be effective for attenuating the amplitude of fluid pulses having shorter wavelengths, in which case the resonator extends axially over at least a substantial portion of the pulse wavelength, prior Helmholtz resonator arrangements may not be effective for attenuating the amplitude of fluid pulses having longer wave lengths. As mentioned above, the primary pumping frequency tends to be rather low, the primary pumping pulses cyclically distributed over a rather long wavelength. By way of the example of a single-speed hermetic reciprocating piston type compressor, the motor thereof rotates at a speed which is directly correlated to the frequency of the alternating current (AC) electrical power which drives it. In the United States, AC power is provided at 60 cycles/second. The electrical current is directed through the windings of the motor stator, and electromagnetically imparts rotation to the rotor disposed inside the stator. The crankshaft of the compressor is rotatably fixed to the rotor and drives the reciprocating piston, which compresses the refrigerant. Thus the primary pumping frequency is at or near 60 cycles per second. The speed of sound in refrigerant gas at the discharge temperature and pressure of this example is 7200 inches per second. Thus, in accordance with the equation:

$$c/f=\lambda \quad (1)$$

where speed "c" is 7200 inches per second and frequency "f" is 60 cycles per second, for the above example wavelength "λ" of the primary pumping pulse is 120 inches. Notably, should the compressor be of the two cylinder variety, twice as many primary pumping pulses will be issued per revolution of the crankshaft; thus λ will then be 60 inches. It can be readily understood by those of ordinary skill in the art that simply providing a single Helmholtz resonator in the discharge line may be largely ineffective for attenuating the amplitude of a pulse which has such a long wavelength, for the point(s) of maximum pulse amplitude, which ought to be coincident with the resonator, may be too far separated. In order for a single Helmholtz resonator to quiet a pulse having such a long wavelength, the resonator would be far too long to facilitate easy packaging within the refrigerant system, let alone within the hermetic compressor housing.

What is needed is a noise attenuation system for a compression device which effectively addresses the noise and vibration issues associated with pressure pulses of relatively long wavelength, such as primary pumping pressure pulses, and which overcomes the above-mentioned limitations of previous muffler arrangements.

Typically, reciprocating piston compressors include a cylinder block having at least one cylinder bore in which is disposed a reciprocating piston. The piston is operatively coupled, normally through a connecting rod, to the eccentric portion of a rotating crankshaft. Rotation of the crankshaft, which may be operatively coupled to the rotor of an electric motor, induces reciprocation of the piston within the cylinder bore.

Covering an end of the cylinder bore, in abutting contact with the cylinder block directly or through a thin gasket member disposed therebetween, and in facing relation to the piston face, is a valve plate provided with suction and discharge ports which are both in fluid communication with the cylinder bore. Each of the suction and discharge ports are provided with a check valve through which gases are respectively drawn into and expelled from the cylinder bore by the reciprocating piston as the piston respectively retreats from or advances toward the valve plate.

The suction and discharge check valves are normally located adjacent and abut opposite planar sides of the valve plate and may, for example, be of a reed or leaf type which elastically deform under the influence of the gas pressure which acts thereon as the gas enters or leaves the cylinder bore through suction and discharge ports provided in the valve plate, and which are covered by the respective valves. The cylinder head is disposed on the side of the valve plate opposite that which faces the cylinder block, and in prior art compressors the head is in abutting contact with the valve plate, directly or perhaps through a thin gasket member disposed therebetween. Alternatively, the valve plate-interfacing surface of the head may be provided with a machined groove in which a seal is disposed, the seal compressed as the head is abutted to the interfacing valve plate surface.

The cylinder head is normally a die cast aluminum or cast iron component which at least partially defines separate suction and discharge chambers therein. Suction pressure gas is introduced into the head suction chamber through an inlet to the head; and the suction pressure gas is drawn by the retreating piston from the head suction chamber through the suction port of the valve plate, past the suction check valve, and into the cylinder bore, where the gas is compressed to substantially discharge pressure. The discharge check valve prevents gas in the discharge chamber from being drawn into the cylinder bore through the discharge port of the valve plate.

Discharge pressure gas in the cylinder bore is expelled through the discharge port of the valve plate, past the discharge check valve, and into the discharge chamber of the head, from which it is expelled through the outlet of the head. The suction check valve prevents gas in the cylinder bore from being expelled into the suction chamber of the head through the suction port of the valve plate. As noted above, the discharge chamber defined by the head of a reciprocating piston compressor may serve as a type of expansion chamber muffler. Enlarging the volume of this chamber by including such a spacer generally improves the head's ability to perform as an expansion type discharge muffler and better attenuate noise associated with pulses carried by the compressed gas.

Moreover, a problem experienced with some reciprocating compressors, particularly those in which the discharge gas is conveyed directly from the head discharge chamber through interconnected conduits to a heat exchanger, is that discharge pressure gas within the head discharge chamber does not readily exit the head, resulting in a pressure buildup in the head discharge chamber during compressor operation. Consequently, the cylinder bore may not be fully exhausted of discharge pressure gas at the end of the compression cycle because the buildup of gas within the head discharge chamber inhibits the accommodation therein of gas being exhausted thereinto from the cylinder. Because gas from the previous compression cycle has not been fully exhausted from the cylinder bore, less suction pressure gas can be drawn into the cylinder during the next compression cycle. Thus, the efficiency of the compressor is compromised. Moreover, the temperature of gas on the discharge side of the system, both within the head itself and the high side of the system, may become excessively high as more and more work is expended on the gas already at discharge pressure.

The previously preferred solution to this problem has been to enlarge the size of the head discharge chamber, thereby allowing gas which is exhausted from the cylinder bore to be more easily compressed into, and accommodated by, the head discharge chamber. As noted above, enlargement of this chamber usually also facilitates improvements in noise quality. One approach to enlarging the head's discharge chamber has been to retool the head. This solution carries with it attendant tooling costs which may not be insubstantial. Further, where a common head design is shared between different compressor models, a newly designed head which solves the problem for one model may not meet the needs (e.g., packaging requirements) of the other model(s), thereby requiring a plurality of head designs to be released and maintained in inventory.

Another approach to enlarging the head's discharge chamber is to provide a spacer between the valve plate and the existing head, which effectively enlarges the volume of the head discharge chamber (and the suction chamber as well). The spacer comprises a separate component which may be used in one compressor but not another, the two compressor models sharing a common head design. These spacers may be made of plastic or metal.

Previous plastic spacers have had coefficients of thermal expansion which differ substantially from those of the cylinder block and/or the head, and consequently may either shrink and thereby cause a leak across its sealing surfaces, or expand and be overly compressed between the valve plate and head, thereby placing considerable additional stress on the spacer, the head and bolts which extend through the spacer and attach the head and spacer to the cylinder block. If so stressed, the spacer may crack and consequently leak. Plastic spacers do, however, provide the benefits of being lightweight, and providing insulation against thermal conduction between the head and the cylinder block, thereby keeping the discharge gas somewhat cooler and thus reducing the capacity required of the heat exchanger which condenses the high pressure gas to a high pressure liquid. Plastic spacers are also made inexpensively by injection molding techniques.

Previous metal spacers, on the other hand, undesirably promote thermal conduction between the head and the cylinder block, weigh more, and usually are die cast and machined, resulting in a relatively more expensive part vis-a-vis a plastic spacer. A metal spacer, however, may have a coefficient of thermal expansion which avoids the above mentioned shrinkage and stress concerns attendant with plastic spacers. Further, prior plastic and metal spacers alike may require additional, separate gaskets to seal the opposite open spacer ends to the valve plate and head in order to provide a proper seal.

What is needed is an inexpensively produced head spacer for increasing the volume of the discharge chamber of the cylinder head, which provides seals between the head spacer and the valve plate, and between the head spacer and the cylinder head, without the need for additional seals.

Further, it is known to dispose an end cap over the end of the annular motor stator in a low-side hermetic compressor, the end cap covering both the stator end and the end of the motor rotor disposed inside the stator. It is also known to drawn suction pressure refrigerant gas from within the end cap through a suction tube extending therefrom which is in fluid communication with the inlet to a compression mechanism driven by the motor and disposed at the opposite end of the motor stator. Such a configuration is shown, for example, in U.S. Pat. Nos. 5,129,793 (Blass et al.) and 5,341,654 (Hewette et al.), and exemplified by the Model AV reciprocating compressors manufactured by the Tecumseh Products Company of Tecumseh, Mich. It is also known to provide suction mufflers in this tube intermediate the stator end cap and the compression mechanism, as taught by Blass et al. '793 and Hewette et al. '654.

A problem with such suction tube arrangements is that their lengths are fixed and particular to stators of a given height. A unique suction tube design must be provided for each different stator height in compressor assemblies which might otherwise be similar, resulting in part complexities and associated inventorying costs and efforts, and additional jigs and fixtures to produce different suction tube assemblies to accommodate these various stators. It would be desirably to provide a single suction tube assembly, with or without a muffler provided therein, which extends between the stator end cap and the inlet to the compression mechanism and can accommodate stators of different heights. Further, it may also be desirable to fix the distance of the muffler from the inlet to the compression mechanism to aid in properly tuning or packaging the muffler, while still accommodating these different stators.

Further still, it is known to resiliently support the motor/compressor assembly, which includes the motor and compression mechanism, within the hermetic shell or housing on a plurality of mounts affixed to the interior of the housing. Typically, these mounts are equally distributed about the interior circumference of the housing or otherwise placed thereabout in a manner which is merely convenient to attachment of the mounts to the motor/compressor assembly.

It is further understood by those of ordinary skill in the art that the housing has natural resonant frequencies that may produce loud, pure, undesirable tones when the housing is vibrated at or near those frequencies. Typically, equally distributing the mounts about the inner circumference of the housing may, at the points of contact therebetween, establish nodes which coincide with at least one of these natural frequencies. Similarly, placement of the mounts merely to facilitate convenient mounting of the motor/compressor assembly may also place these points of contact at nodes of natural frequencies which produce loud tones. Thus, previous compressors do not beneficially place the motor/compressor mounts on the housing in a manner which addresses the noise associated with excitation of these natural frequencies. To do so would reduce or eliminate the housing's natural resonant frequencies, and reduce the noise produced thereby.

SUMMARY OF THE INVENTION

One aspect of such a noise attenuation system for a compression device relates to an improved discharge pulse reduction system which comprises at least one muffler located in a discharge fluid line, the muffler spaced along the discharge line at a distance from a compressor discharge chamber or another upstream muffler which is a particular fraction or multiple of the wavelength of the primary pumping frequency. Thus, the amplitude of the primary pumping frequency, which may be reduced in the above-mentioned compressor discharge chamber or upstream muffler, is further reduced by the muffler placed at the above-mentioned distance therefrom, at which the already reduced amplitude reaches its new maximum value. Thus, the amplitude of the pulse at the primary pumping frequency is twice attenuated, improving the noise and vibration characteristics of the compressor and/or the refrigerant system into which it is incorporated. The muffler(s) may be of the Helmholtz or expansion chamber type.

Accordingly, the present invention provides a compressor assembly including a compression mechanism into which a gas is received substantially at a suction pressure and from which the gas is discharged substantially at a discharge pressure, the gas discharged from the compression mechanism carrying pressure pulses having a particular frequency and wavelength, these pressure pulses being of variable amplitude. A first muffler is provided through which the gas discharged from the compression mechanism flows, and a second muffler is provided in series communication with the first muffler and through which the gas having flowed through the first muffler flows. The first and second mufflers are spaced by a distance which is substantially equal to an odd multiple of one quarter of the wavelength, the amplitude being reduced in response to the gas having flowed through the second muffler.

The present invention also provides a compressor assembly including a compressor mechanism into which a gas is received substantially at a suction pressure and from which the gas is discharged substantially at a discharge pressure, the gas discharged from the compression mechanism carrying pressure pulses having a particular frequency and wavelength, these pressure pulses being of variable amplitude. Also provided is a conduit through which gas substantially at discharge pressure flows, and means for reducing the amplitude of the pressure pulses at locations at which the amplitudes reach their highest absolute values.

The present invention further provides a method for reducing the amplitude of pressure pulses having a particular wavelength in a fluid, including: flowing the pressure pulse-containing fluid through a conduit; attenuating the pressure pulse amplitude at a first location along the conduit; and further attenuating the pressure pulse amplitude at a second location along the conduit distanced from the first location a distance which is substantially equal to an odd multiple of one quarter of the wavelength.

A head spacer is provided for increasing the volume of a discharge chamber in the cylinder head assembly of a reciprocating piston compressor, in which the head spacer is disposed between a valve plate and a cylinder head, and has a plurality of substantially concentric, alternating ridges and valleys disposed around the periphery of first and second end surfaces of the head spacer. When the cylinder head is torqued down onto the cylinder block in response to a compressive load exerted on the cylinder head during the assembly of the cylinder head assembly, the tips of the ridges deform to form a continuous labyrinth seal between the head spacer and the cylinder head, and between the head spacer and the valve plate.

The head spacer may be made from an injection-molded plastic, and has a coefficient of thermal expansion which is substantially similar to the metal components of the cylinder head assembly, such that the head spacer may shrink and/or expand at the same rate as the cylinder block and cylinder head. Further, the plastic from which the head spacer is made provides insulation against thermal conduction between the valve plate and the cylinder head.

In one form thereof, a reciprocating piston compressor is provided, including cylinder block having a cylinder bore; a piston reciprocatingly disposed in the cylinder bore; a cylinder head connected to the cylinder block and partially defining a suction chamber into which gas is received and from which the gas exits into the cylinder bore substantially at a suction pressure, the cylinder head partially defining a discharge chamber into which gas is received from the cylinder bore and from which the gas exits substantially at a discharge pressure; a valve plate having a suction port through which the cylinder bore and the suction chamber fluidly communicate, and a discharge port through which the cylinder bore and the discharge chamber fluidly communicate; a suction check valve disposed over the suction port and past which gas flows from the suction chamber to the cylinder bore, flow from the cylinder bore to the suction chamber being inhibited by the suction check valve; a discharge check valve disposed over the discharge port and past which gas flows from the cylinder bore to the discharge chamber, flow from the discharge chamber to the cylinder bore being inhibited by the discharge check valve; and a spacer disposed between the valve plate and the cylinder head, the spacer having generally opposite first and second end surfaces, each of the first and second spacer and surfaces respectively abutting an interfacing surface of the valve plate and the cylinder head, the spacer partially defining the discharge chamber, a substantial portion of the volume of the discharge chamber located between spacer end surfaces; wherein the first and second spacer end surfaces are each provided with a plurality of substantially concentric ridges having tips, the ridge tips having one of a deformed state and an undeformed state, adjacent ones of the ridges separated by a valley, the ridge tips being placed in the deformed state in response to a compressive load exerted on the spacer between the valve plate and the cylinder head during assembly of the compressor, the deformed ridge tips providing a seal between the first spacer end surface and the valve plate, and between the second spacer end surface and the cylinder head.

In a further form thereof, a cylinder head spacer for a reciprocating piston compressor is provided, including a body portion made of a plastic material and having a substantially open interior extending between first and second end surfaces; and a plurality of substantially concentric, alternating ridges and valleys extending around a periphery of each of the first and second end surfaces, the ridges having one of a deformed state and an undeformed state, the ridges being placed in the deformed state in response to a compressive load exerted on the first and second end surfaces, such that the ridges extend into the valleys and contact adjacent ridges to form sealing surfaces, the sealing surfaces coplanar with the first and second end surfaces.

In another form thereof, a method of assembling a reciprocating piston compressor having a cylinder block with a cylinder bore opening, a valve plate, and a cylinder head, is provided, including the steps of providing a spacer having first and second end surfaces each provided with a plurality of substantially concentric ridges having tips, the ridge tips having one of a deformed state and an undeformed state, adjacent ones of the ridge tips separated by a valley; orienting the valve plate, the spacer, and the cylinder head in a stack arrangement over the cylinder bore opening; and exerting a compressive load on the ridge tips to deform the ridge tips to the deformed state, the deformed ridge tips providing sealing contact between the first spacer end surface and the valve plate, and between the second spacer end surface and the cylinder head.

In a still further form thereof, a method is provided of assembling a cylinder head assembly of a reciprocating piston compressor, the compressor having a cylinder block with a bolt hole therein, including the steps of providing a bolt, a suction leaf plate, a valve plate, and a cylinder head, each of which include a bolt hole therein; providing a spacer having a bolt hole, and first and second end surfaces each provided with a plurality of continuous, alternating ridges and valleys extending around a periphery of each of the first and second end surfaces, the ridges including tips having one of a deformed state and an undeformed state; positioning the suction leaf plate, the valve plate, the spacer, and the cylinder head, respectively, on the cylinder block such that the bolt holes are aligned; inserting the bolt through the bolt holes, and tightening the bolt to exert a compressive load on the ridge tips and deforming the ridge tips to the deformed state, the deformed ridge tips providing sealing contact between the first spacer end surface and the valve plate, and between the second spacer end surface and the cylinder head.

One advantage of the present head spacer is that it is inexpensively produced, and, because the head spacer comprises an individual component, the head spacer may used with existing compressor designs without retooling other components of the cylinder head assembly.

Another advantage is that the labyrinth seal produced by the deformation of the ridge tips of the head spacer obviates the need for additional seals between the head spacer and the valve plate, and between the head spacer and the cylinder head.

A further advantage is that the plastic material of the head spacer both provides insulation against thermal conduction between the cylinder block and the cylinder head, and has a coefficient of thermal expansion substantially similar to the other metal components of the cylinder head assembly to prevent the leakage due to the shrinkage and expansion which is observed with existing head spacers.

Another aspect of the inventive noise attenuation system for a compression device relates a suction tube assembly which extends between the stator end cap and the inlet to the compression mechanism, and may be telescoped in the general direction of the stator's longitudinal axis to accommodate stators of different heights. Certain embodiments of this suction tube assembly include a muffler, and this muffler may have a location which is fixed relative to the compression mechanism.

Accordingly, the present invention provides a compressor assembly including a compression mechanism having an inlet into which a gas substantially at suction pressure is received, and an outlet from which gas compressed by the compression mechanism is discharged substantially at a discharge pressure. A motor is also included which includes a rotor and a stator, the stator substantially surrounding the rotor and having an end, the rotor operatively coupled with the compression mechanism. An end cap is disposed over the stator end, the end cap having an interior in which is gas substantially at suction pressure. A suction tube of variable length is also provided through which the compression mechanism inlet and the end cap interior are in fluid communication, the suction tube comprising first and second tubes which are in sliding, telescoping engagement, whereby the length of the suction tube may be adjusted through relative axial movement of the first and second tubes.

The present invention also provides a compressor assembly including a compression mechanism having an inlet into which a gas substantially at suction pressure is received, and an outlet from which gas compressed by the compression mechanism is discharged substantially at a discharge pressure, and a motor having a rotor and a stator selected from a plurality of stators of differing heights. The stator substantially surrounds the rotor and has opposite ends distanced by the stator's height. The rotor is operatively coupled with the compression mechanism. An end cap is disposed over one of the stator ends and has an interior substantially at suction pressure, and first and second telescopingly engaged tubes defining a suction tube which extends axially over at least a portion of the stator height and through which the end cap interior and the compression mechanism inlet are in fluid communication. The suction tube has a length which is varied in response to the relative axial positions of the telescopingly engaged first and second tubes, whereby the suction tube length may be varied to accommodate a different stator alternatively selected from the plurality of stators.

Further, the present invention provides a compressor assembly including a compression mechanism having an inlet into which a gas substantially at suction pressure is received, and an outlet from which gas compressed by the compression mechanism is discharged substantially at a discharge pressure, and a motor having a rotor and a stator selected from a plurality of stators of differing heights. The stator substantially surrounds the rotor and has opposite ends distanced by the stator's height. The rotor is operatively coupled with the compression mechanism. An end cap is disposed over the stator and has an interior in which is gas substantially at suction pressure, the end cap being distanced from the compression mechanism inlet an amount dependent upon the stator's height. A tube assembly is provided through which gas is directed from the end cap interior to the compression mechanism inlet, the tube having means for adjusting its length, whereby the compressor assembly could alternatively comprise a different stator selected from the plurality of stators.

Still another aspect of the inventive noise attenuation system for a compression device relates to motor/compressor assembly mounts which are attached to the interior of the compressor housing in a manner which reduces or eliminates natural resonant frequencies of the housing. The mounts are distributed unequally about the inner circumference of the housing and attached thereto a positions which do not coincide with nodes of these frequencies. That is, the mounts are secured to the inside of the housing to interfere with the wave form produced by the natural frequencies in the compressor housing so as to reduce objectionable noise. Resonation of the housing at these natural frequencies is thus prevented, and the compressor quieted.

Accordingly, the present invention provides a compressor assembly including a housing having at least one natural frequency having a wave form with amplitude large enough for the housing, when vibrated at that frequency, to produce an objectionable noise. The natural frequency wave form has a plurality of natural nodes equally distributed about the circumference of the housing and natural anti-nodes located between adjacent natural nodes. A motor/compressor assembly is also provided which includes a compression mechanism in which gas is compressed from substantially a suction pressure to substantially a discharge pressure, and a motor operably engaged with the compressor mechanism. A plurality of mounts are unequally distributed about the circumference of the housing, the motor/compressor assembly being supported within the housing by the mounts. Each mount is attached to the housing at a first point, the first points not coinciding with the natural nodes of the natural frequency wave form. These first points define forced nodes on the circumference of the housing to which the nodes of the natural frequency wave form are forced, and the natural frequency wave form is altered in response to the natural nodes being forced to the forced nodes, whereby the housing is prevented from vibrating at the natural frequency.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Figure 1:
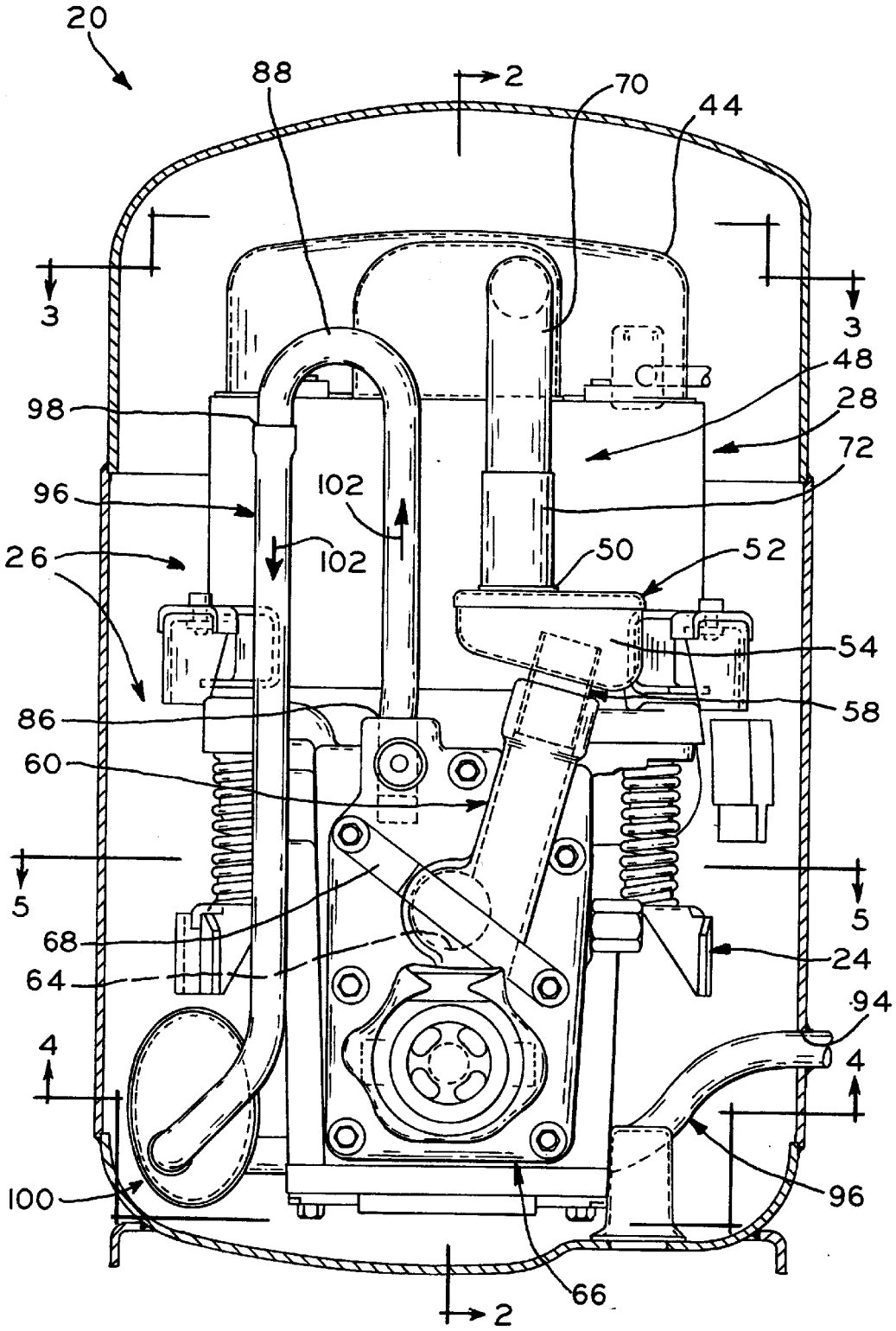
FIG. 1 is a first longitudinal sectional view of a first embodiment of a compressor in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE INVENTION

Figure 2:
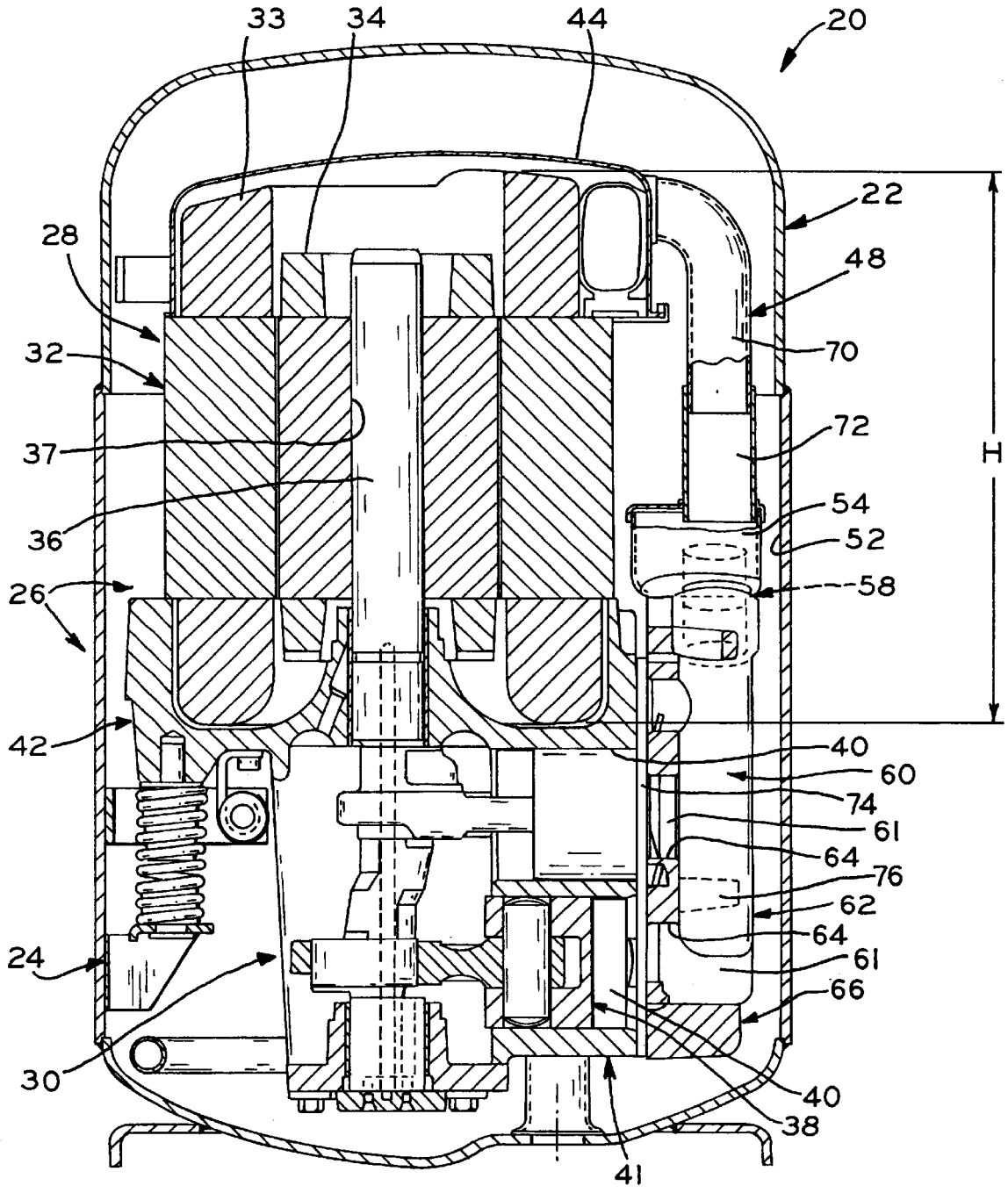
FIG. 2 is a second longitudinal sectional view of the compressor shown in FIG. 1, along line 2—2.

Referring to FIGS. 1 and 2 there is shown a first embodiment of a reciprocating piston compressor assembly according to the present invention. Reciprocating piston compressor assembly 20 is a hermetic compressor assembly which may be part of a refrigeration or air-conditioning system (not shown). Compressor 20 is a 5-ton compressor having a displacement of approximately 5.6 cubic inches. Compressor assembly 20 comprises housing 22 having an interior surface to which mounts 24 are attached (FIGS. 1–5). Mounts 24 include springs which resiliently support motor/compressor assembly 26, to vibrationally isolate the motor/compressor assembly from housing 22 in a manner that will be described hereinbelow. Motor/compressor assembly 26 comprises motor 28 and compression mechanism 30. In the depicted embodiment, compression mechanism 30 is of the reciprocating piston type, although it is to be understood that certain aspects of the present invention may be adapted to other types of compressor assemblies. Previous reciprocating piston compressors are described in U.S. Pat. No. 5,224,840 (Dreiman et al.) and U.S. Pat. No. 5,951,261 (Paczuski), the disclosures of which are expressly incorporated herein by reference. These incorporated patents are assigned to the assignee of the present invention.

Motor 28 comprises stator 32 which is provided with windings 33, and rotor 34 as illustrated in FIG. 2. Alternating current from an external power source (not shown) is directed through stator windings 33 via terminal cluster 35 (FIGS. 3, 4 and 5) to electromagnetically induce rotation of rotor 34. Crankshaft 36 extends longitudinally through central aperture 37 in rotor 34 to which it is rotatably attached to drive compression mechanism 30. Shaft 36 is operably coupled to a pair of pistons 38 which are reciprocatively disposed in cylinder bores 40 formed in cylinder block 41 of cast-iron crankcase 42, which is attached to the lower one of two opposite ends of the stator.

Figure 3:
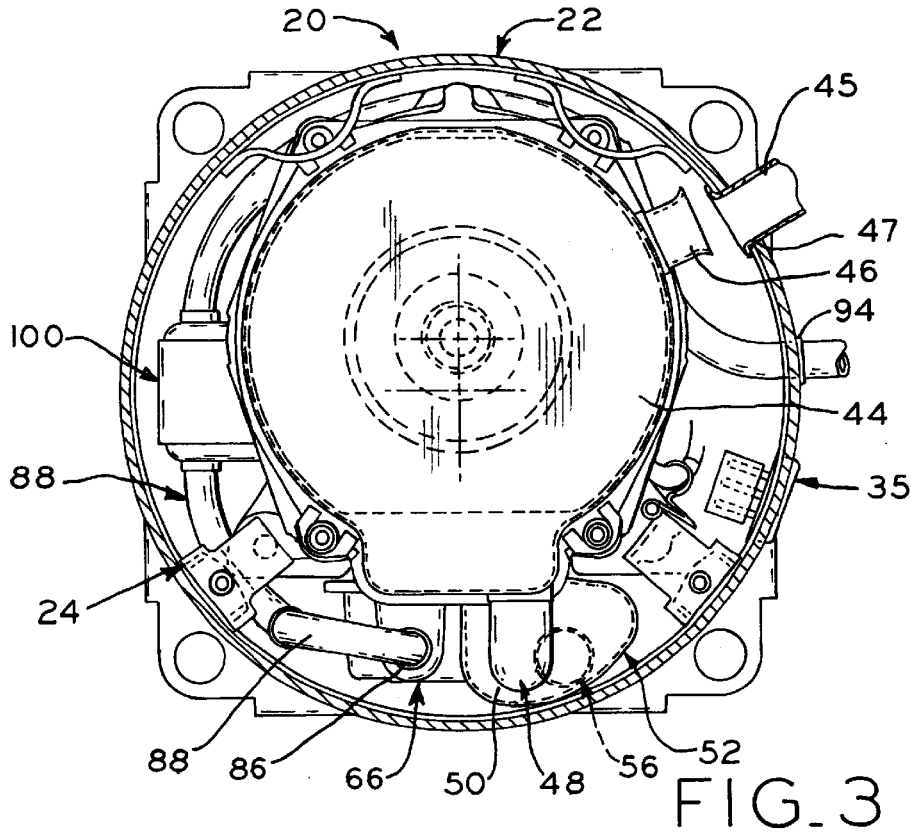
FIG. 3 is a sectional view of the compressor shown in FIG. 1, along line 3—3.
Figure 7A:
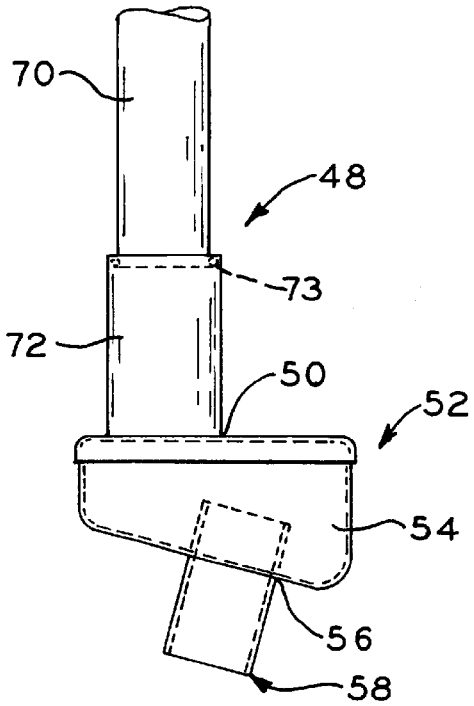
FIG. 7A is a first side view of the suction muffler of the compressor shown in FIG. 1.
Figure 7B:
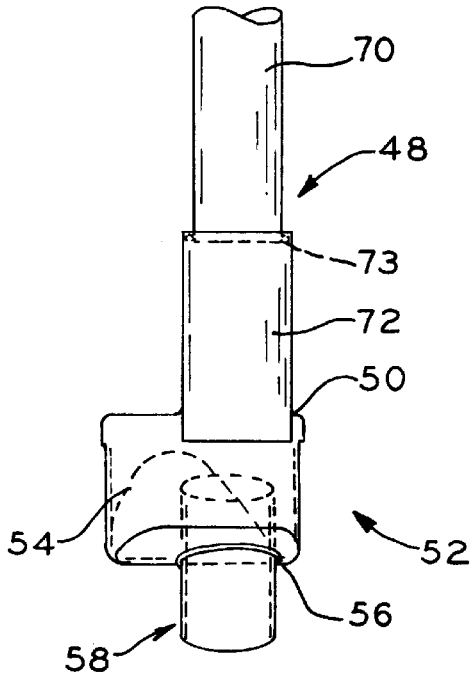
FIG. 7B is a second side view of the suction muffler shown in FIG. 7A.
Figure 7C:
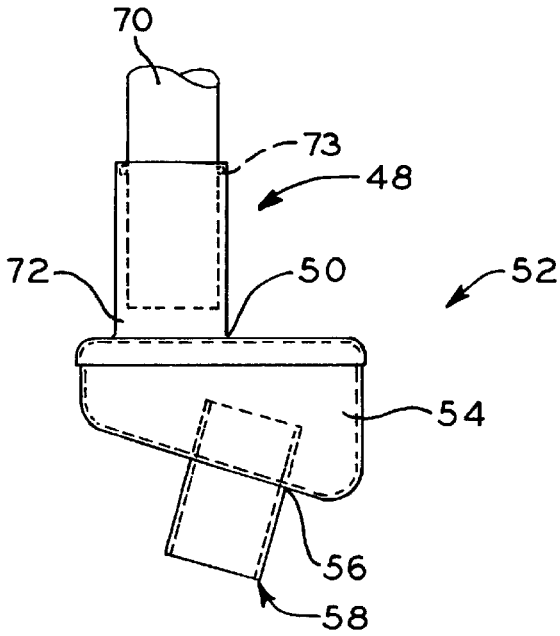
FIG. 7C is a third side view of the suction muffler shown in FIG. 7A, in an alternative configuration in which the inlet tube thereof is shortened.

During compressor operation, refrigerant at suction pressure is drawn into housing 22; compressor assembly 20 is a low-side compressor, motor 28 being in a low pressure and low temperature environment. The suction pressure refrigerant is drawn into housing 22 through inlet 45 which is held securely within aperture 47 located in the side of housing 22 by welding, brazing or the like (FIG. 3). As illustrated in FIG. 3, inlet 45 is substantially aligned with suction inlet 46 located in one side of motor end cap 44 such that as suction pressure refrigerant is drawn into housing 22, a portion of the fluid enters motor end cap 44 through inlet 46. The remainder of the suction pressure fluid circulates within housing 22. The suction pressure refrigerant which flows into motor end cap 44, flows over the top of motor 28 to cool the top end thereof. The refrigerant exits motor end cap 44 through suction tube 48 which leads to inlet 50 of suction muffler 52. Suction muffler 52 is a steel, expansion type muffler shown in FIGS. 7A–7C and includes expansion chamber 54 having a volume of 3.531 cubic inches. Alternatively, suction muffler 52 may be modified such that its expansion chamber 54 has a volume of 4.63 cubic inches. Suction muffler 52 has inlet 50 and outlet 56 which are sealingly connected to suction tubes 48 and 58, respectively (FIGS. 7A-7C). Suction tubes 48 and 58 have a diameter of approximately ⅞ inch and along with muffler 52 are constructed from a material such as steel. Although the openings suction tubes 48 and 58 are shown as being substantially offset within expansion chamber 54 (FIG. 7A), muffler 52 may be modified to more closely align these openings so that fluid may flow more directly between them within chamber 54. Moreover, those of ordinary skill in the art will recognize that the extent to which the ends of tubes 48 and 58 extend into chamber 54 may vary considerably depending on the frequency being attenuated within the muffler.

As shown in FIGS. 1 and 2, suction tube 58 is received in one end of suction plenum 60 which is secured at end 62 to cylinder head inlets 64 of cylinder head 66. Suction plenum 60 is a plastic insert into which steel tube 58 is interference fitted and is held in place over suction chamber 61 in cylinder head 66 by strap 68. Suction muffler 52 is tuned to attenuate noises created by suction check valves and pressure pulses having a frequency between 1000 and 1400 hertz.

Referring to FIGS. 7A–7C, in the shown embodiment of the present invention, suction tube 48 includes first tube 70 and second tube 72 in which the outer and inner diameters, respectively, are telescopically engaged. Suction tube 48 is constructed from steel, but may be constructed from any suitable material to withstand the compressor environment. First tube 70 has an outer diameter of ⅞ inch and is of a slightly smaller diameter than second tube 72, which has an outer diameter of 1 inch. A sealing member such as O-ring 73 is disposed between first tube 70 and second tube 72 so as to sealingly engage the inner surface of second tube 72 with the outer surface of first tube 70. First portion 70 is then telescopically movable within second tube 72 to provide an adjustable suction tube 48 having different lengths to accommodate different stator heights H (FIG. 2), i.e., the distance between the opposite ends of a stator. The position of muffler 52 is such that tubes 70 and 72 are axially aligned along the general direction of the stator height.

As shown in FIG. 2, from suction muffler 52, suction pressure gas is introduced into suction plenum 60 and into suction chamber 61 of cylinder head 66 from which the gas is drawn by the retreating pistons 38 through the suction check valves of valve assembly 74 (FIGS. 8A and 8B), and into cylinder bores 40, wherein the gas is compressed to substantially discharge pressure. Cylinder head 66 is a material such as cast iron or aluminum. Once compressed, the discharge pressure gases flow past the discharge valve of valve assembly 74 and into discharge chamber 76 defined within cylinder head 66. Discharge chamber 76 of this embodiment is of a size which is great enough to act as an expansion type muffler wherein the amplitude of the pressure wave of the compressed fluid is altered, thereby attenuating the noise created by the operation of the discharge valves and the primary pumping frequency. The volume of discharge chamber 76 is 6.93 cubic inches.

Figure 8B:
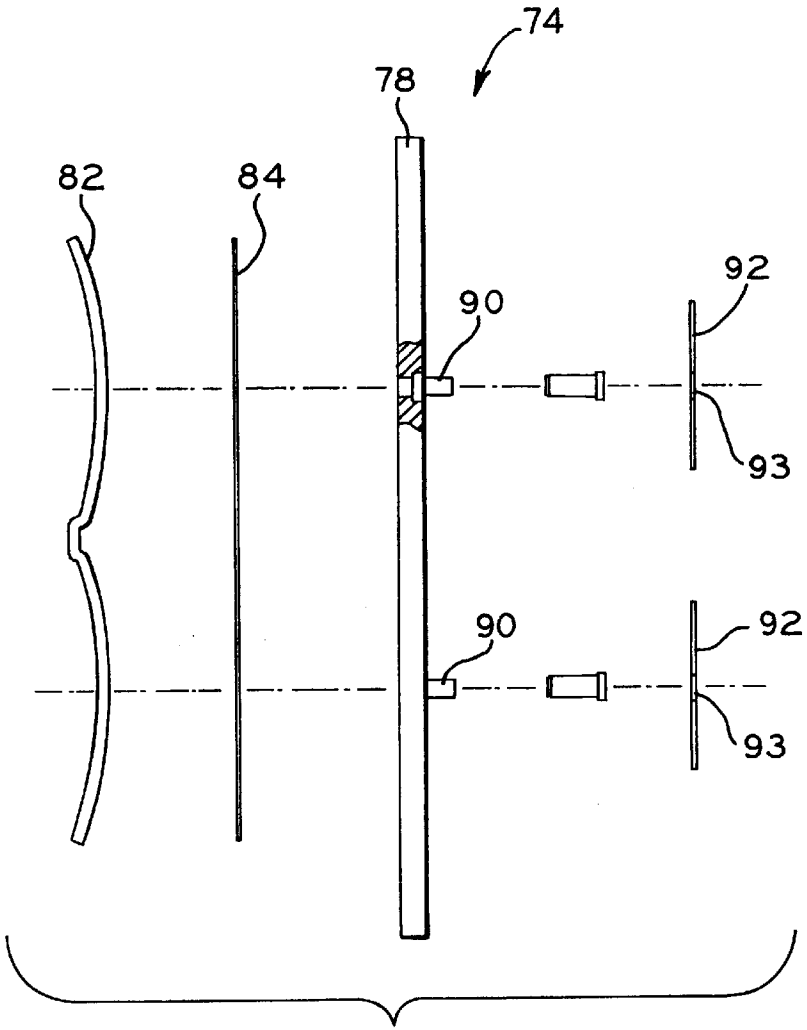
FIG. 8B is an exploded side view of the valve assembly shown in FIG. 8A.
Figure 8A:
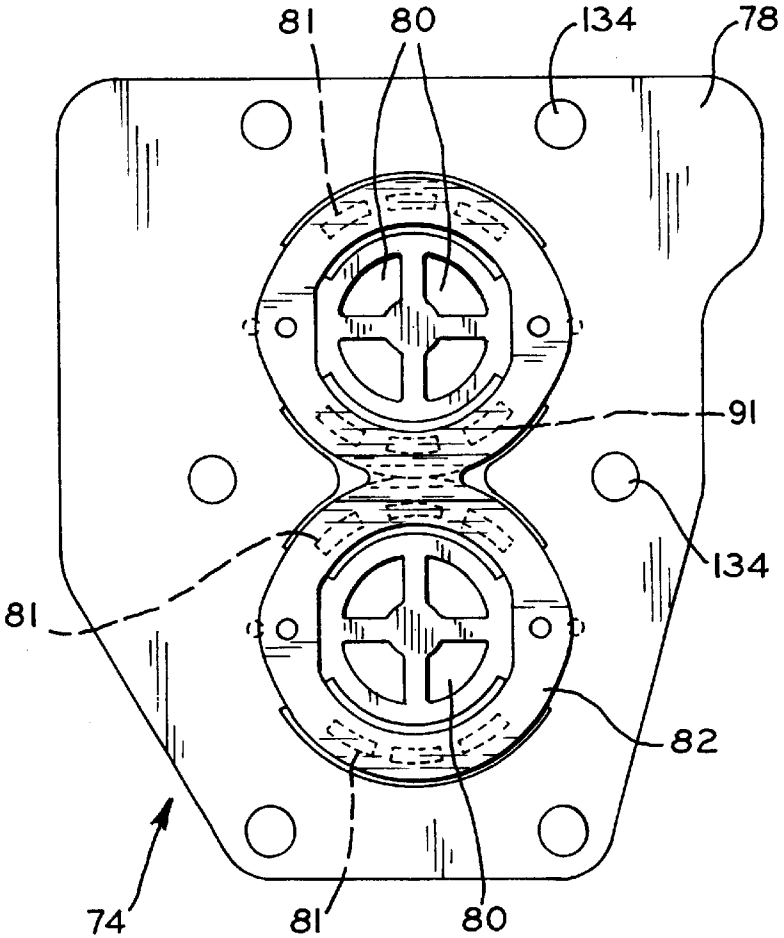
FIG. 8A is an enlarged plan view of the valve assembly of the compressor shown in FIG. 1.

In the usual fashion, valve assembly 74 is provided between crankcase 42 and cylinder head 66 to direct the suction pressure and discharge pressure gases into and out of cylinder bores 40. Valve assembly 74 is illustrated in FIGS. 8A and 8B and includes valve plate 78 having centrally located suction ports 80 and surrounding discharge ports 81 shown in dashed lines in FIG. 8A. Discharge ports 81 are disposed beneath retaining plate 82. Valve plate 78 and retaining plate 82 are constructed from a material such as steel. Between valve plate 78 and retaining plate 82 are discharge check valves 84 which open and close discharge ports 81. Discharge check valves 84 are made from spring steel, as is well known in the art. Each discharge check valve 84 prevents gas in discharge chamber 76 from being drawn into a cylinder bore 40 through the associated discharge ports 81 of valve plate 78. Discharge pressure gas in cylinder bores 40 is expelled through the discharge ports of valve plate 78, past discharge check valves 84, and into discharge chamber 76, from which it is expelled through outlet 86 of cylinder head 66 into discharge tube 88 (FIGS. 1 and 3).

Positioned on the opposite side of valve plate 78 are a pair of pins 90 which are aligned across suction ports 80 and fixed to valve plate 78. Thin metal suction check valves 92 are constructed from spring steel as are discharge check valves 84 and include a pair of slots 93, one being disposed at opposite ends of valves 92 (FIG. 8B). Suction check valves 92 are positioned so that pins 90 are received within slots 93 to guide valves 92 between open and closed position. Suction valves 92 prevent gas in cylinder bores 40 from being expelled into suction chamber 61 in cylinder head 66 through suction ports 80 of valve plate 78. In this particular compressor 20, two valve assemblies 74 are provided on common plate 78, one valve assembly 74 being disposed over each cylinder bore 40.

Figure 4:
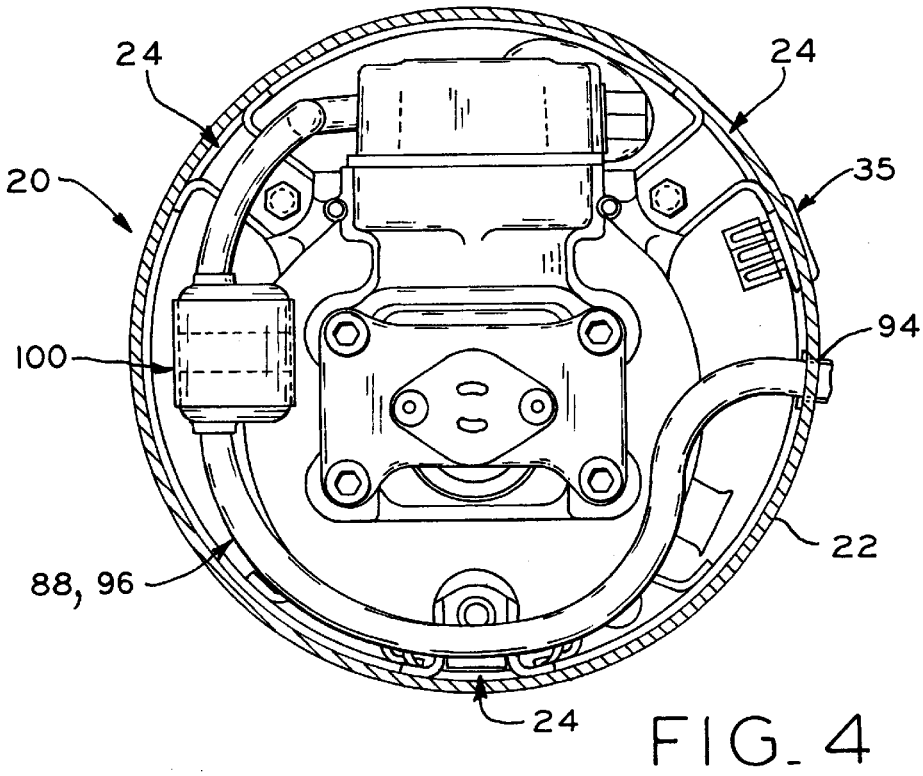
FIG. 4 is a sectional view of the compressor shown in FIG. 1, along line 4—4.
Figure 9A:
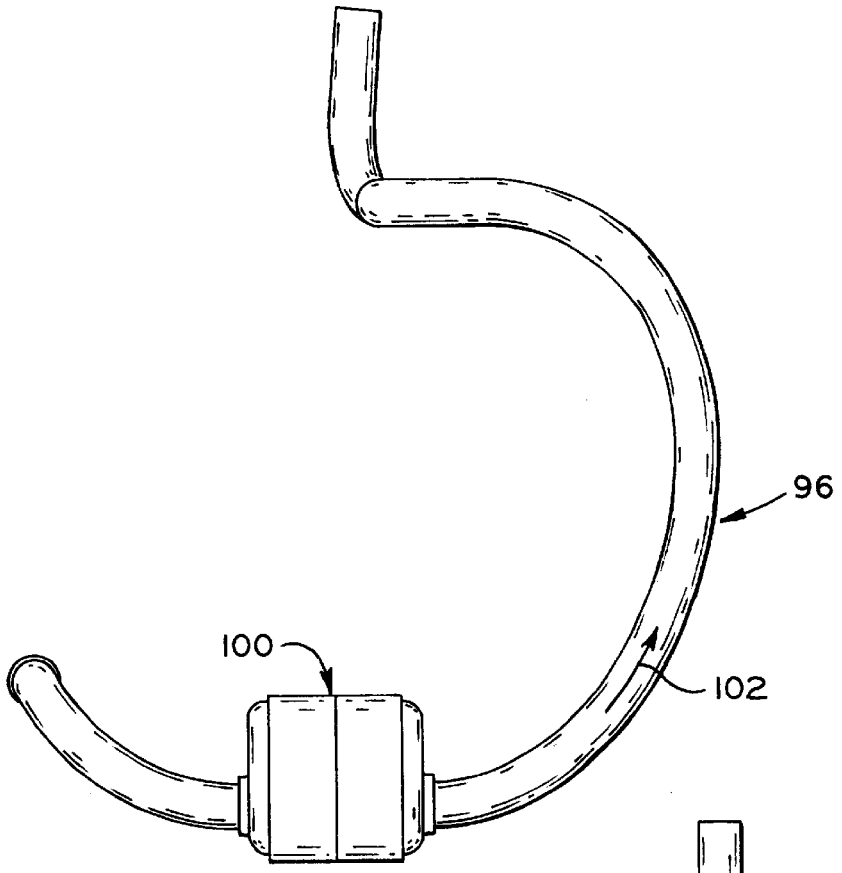
FIG. 9A is a first plan view of a discharge tube of the compressor shown in FIG. 1, the discharge tube including a discharge muffler.
Figure 9B:
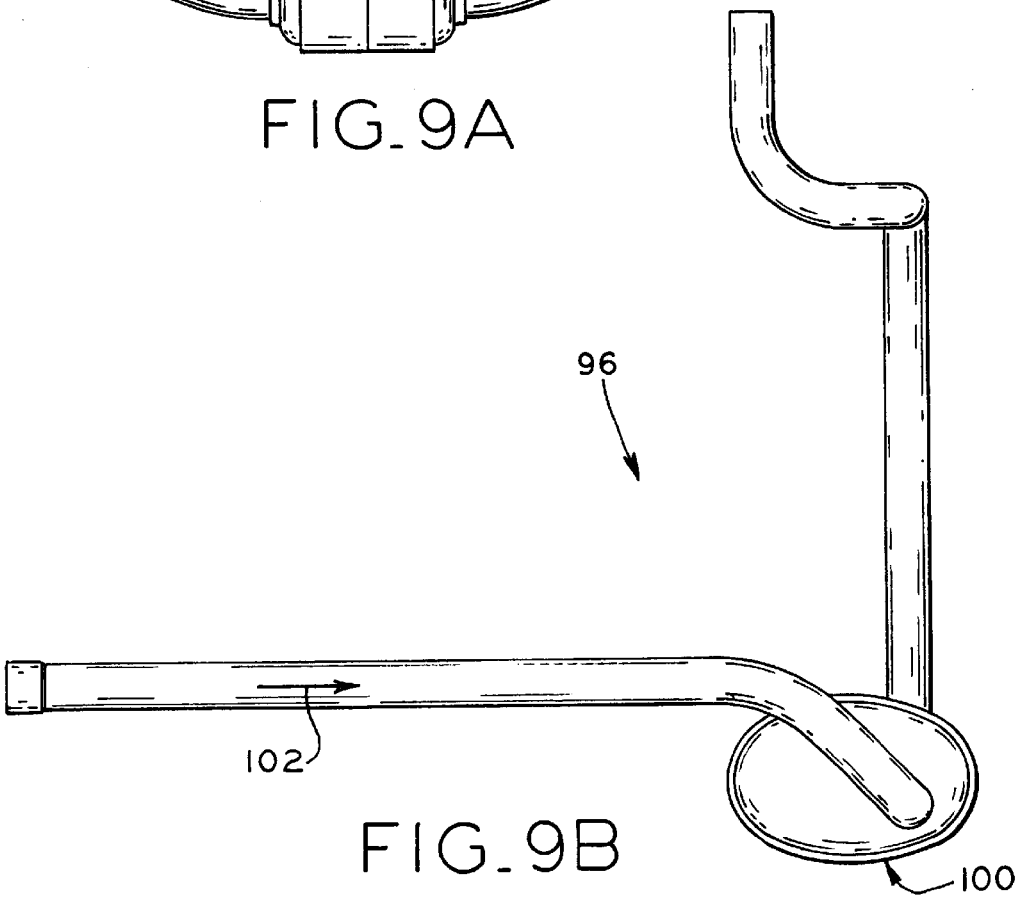
FIG. 9B is a second plan view of the discharge tube of FIG. 9A.

The discharge pressure gases in discharge 76 are directed into a discharge tube which, as shown, may be comprised of multiple, series-connected tubes. The discharge tube extends from head 66 through aperture 94 in housing 22, and is connected to the remainder of the refrigerant system (FIGS. 1, 3, and 4). This housing aperture is sealed about the discharge tube by any suitable manner. Referring now to FIGS. 9A and 9B there is shown discharge tube 96 which comprises part of the compressor discharge tube assembly. Discharge tube 96 is somewhat flexible in nature so that shocks associated with pressure pulses may be absorbed by the resilient flexing of tube 96. Discharge tube 96 is secured to discharge tube 88 at 98 by any suitable method such as welding or brazing (FIG. 1).

Located along discharge tube 96 is expansion type discharge muffler 100 which is a second muffler of compressor assembly 20 for further reducing the undesirable noise in the refrigerant gas. Flow of compressed refrigerant gas is directed along discharge tube 88 and discharge tube 96 in the direction of arrows 102 through muffler 100 (FIGS. 1, 9A and 9B). Both discharge tube 88 and discharge tube 96 are approximately ½ inch in diameter and are formed from a material such as steel. Muffler 100 is specifically spaced from discharge chamber 76 in cylinder head 66 in accordance with the present invention as will be described hereinbelow.

Figure 10:
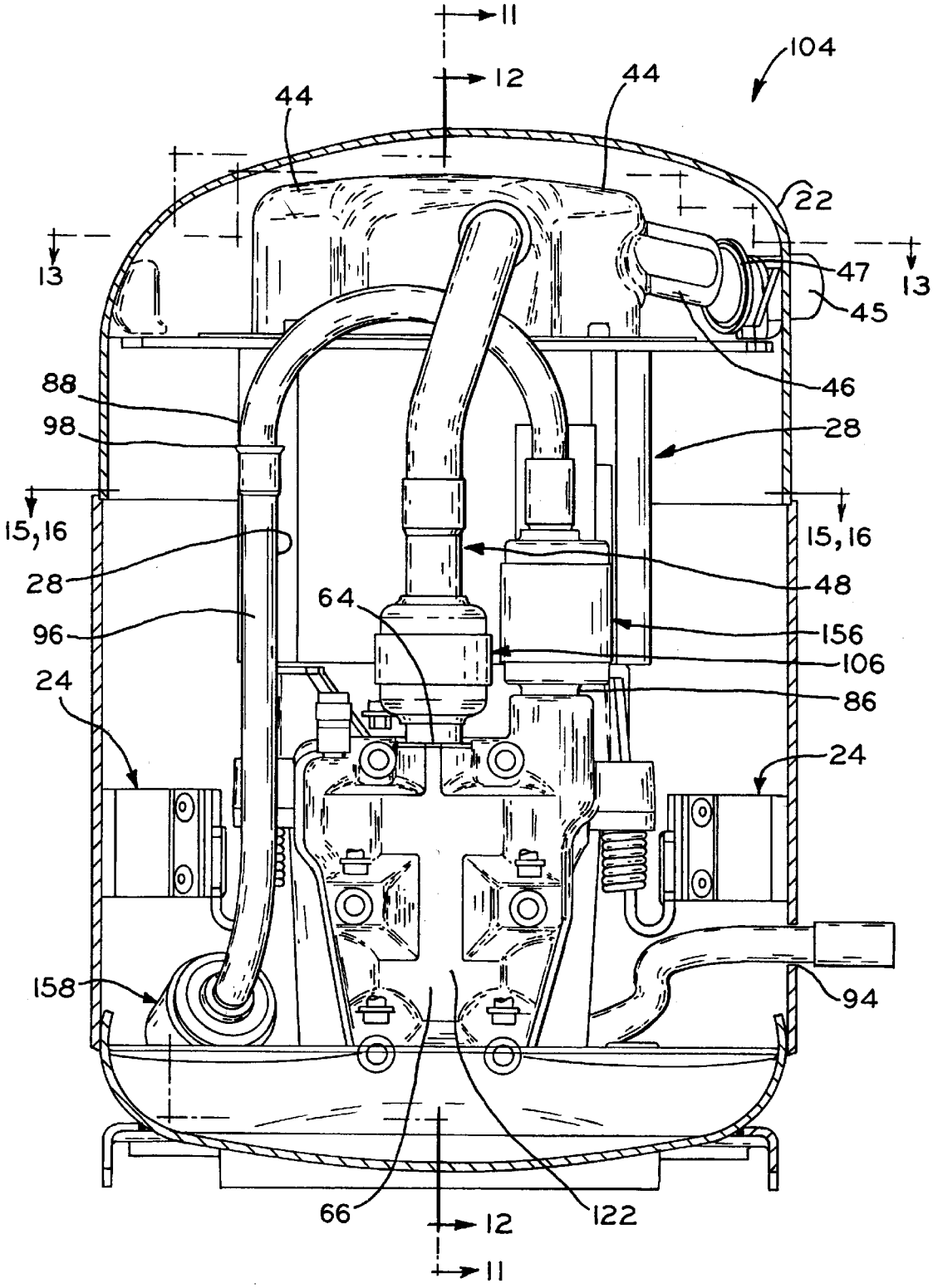
FIG. 10 is a first longitudinal sectional view of a second embodiment of a compressor according to the present invention.
Figure 11:
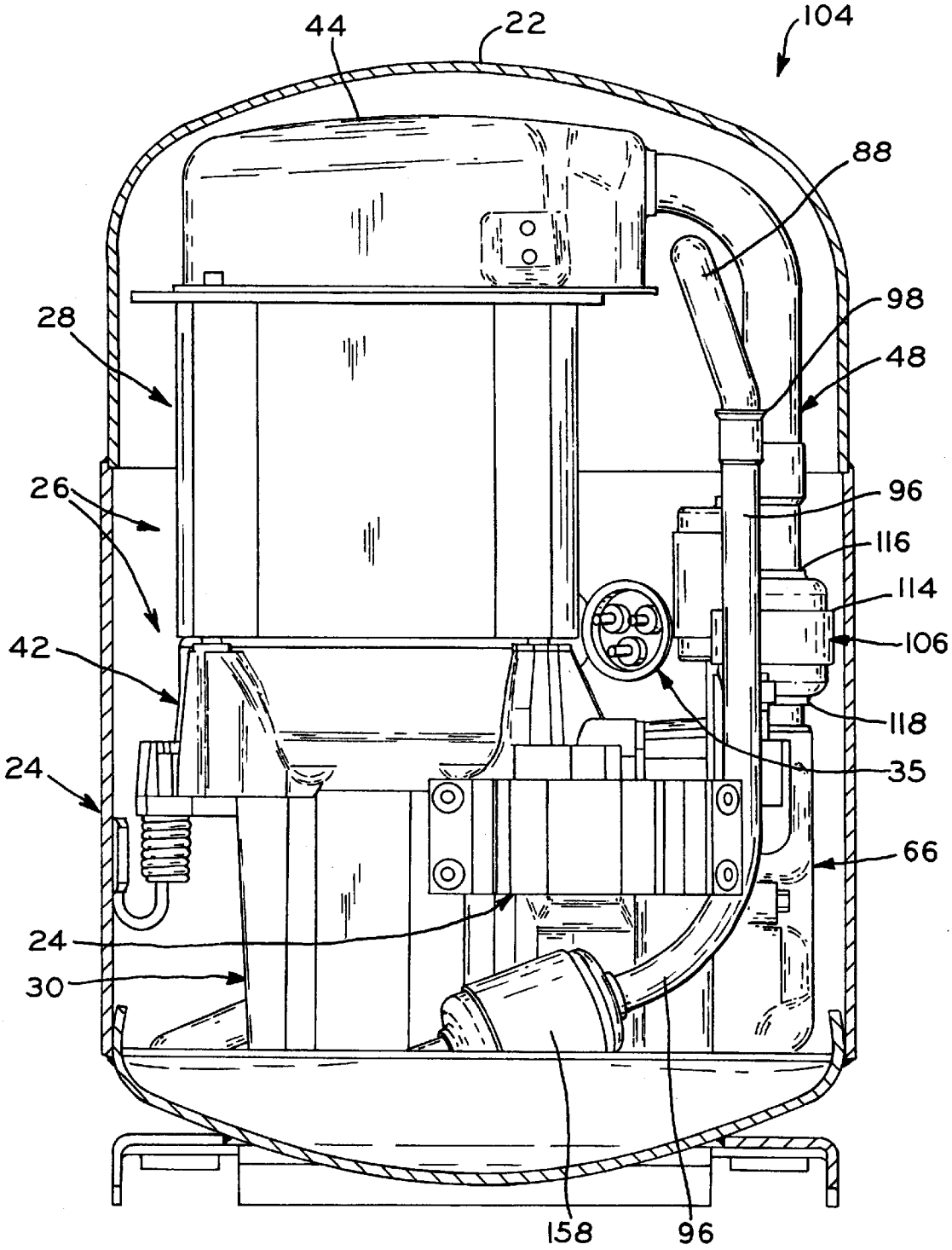
FIG. 11 is a second longitudinal sectional view of the compressor shown in FIG. 10, along line 11—11.
Figure 12:
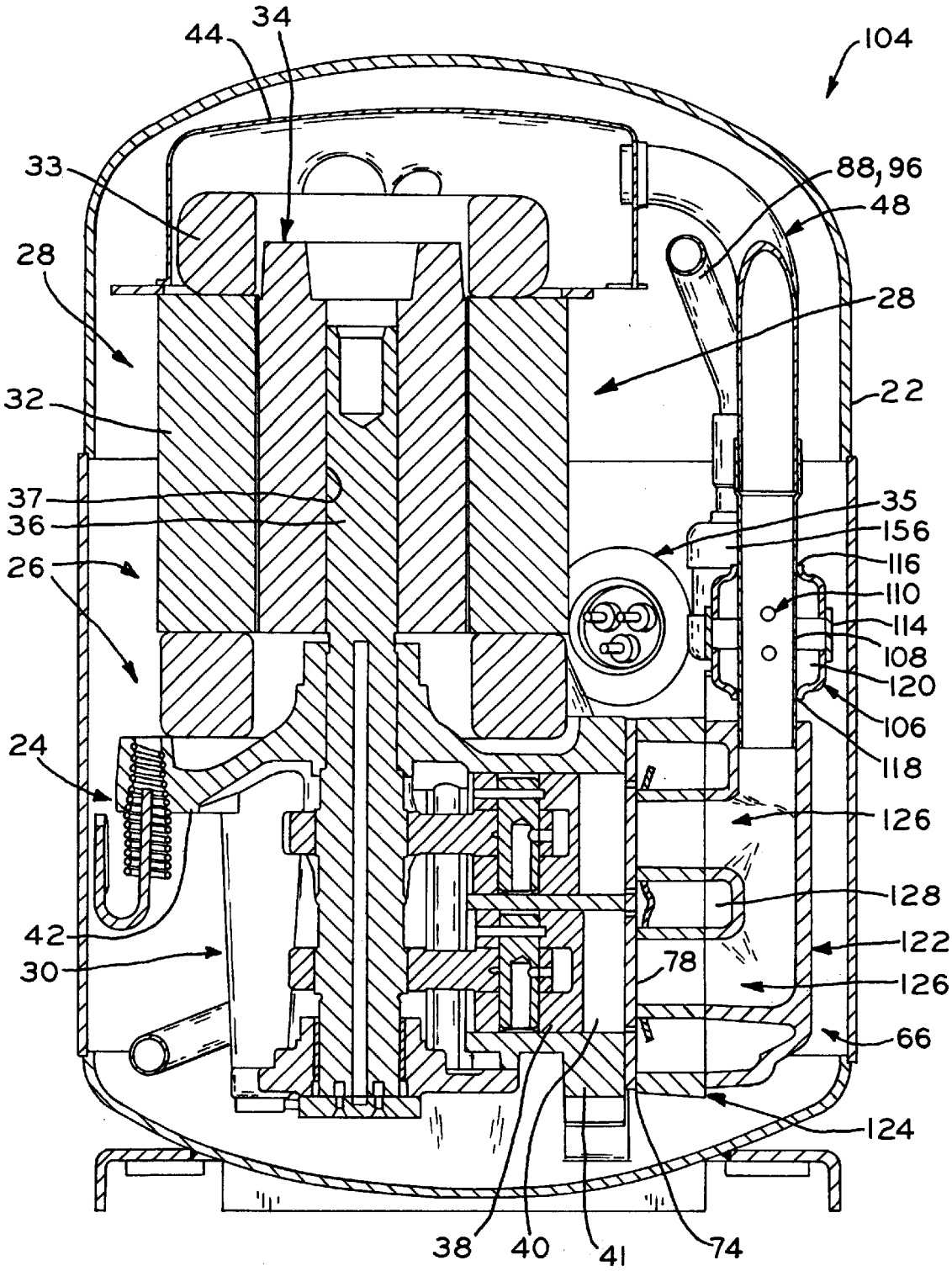
FIG. 12 is a third longitudinal sectional view of the compressor shown in FIG. 10, along line 12—12.
Figure 13:
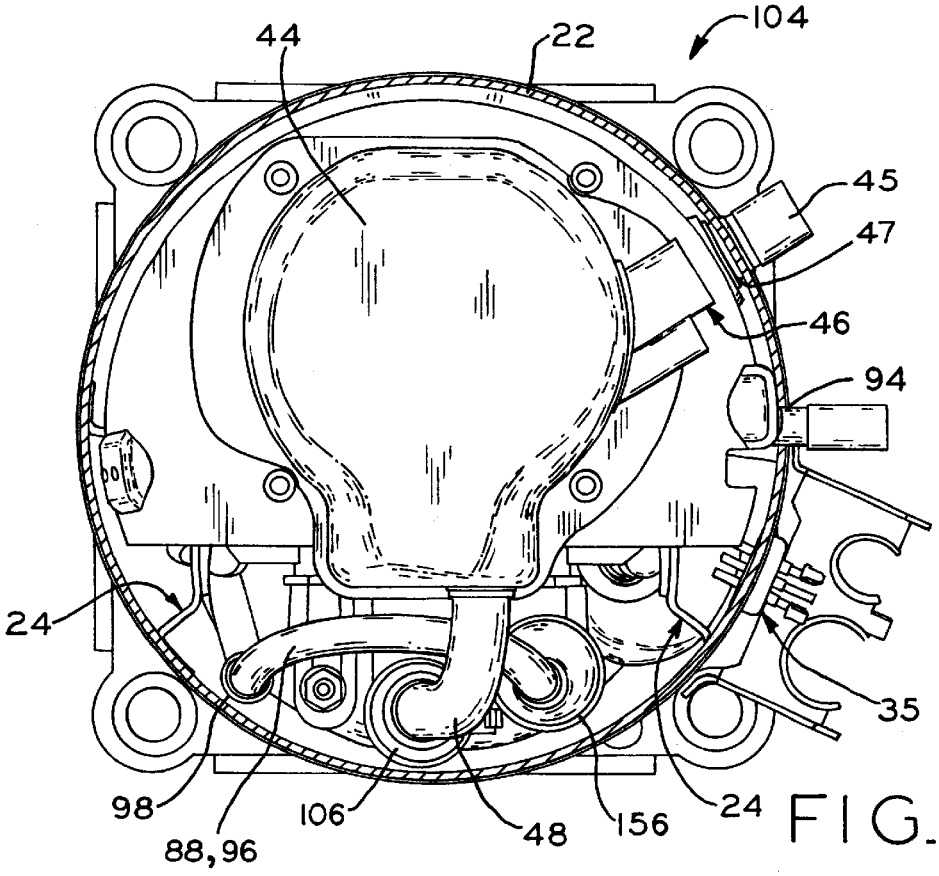
FIG. 13 is a sectional view of the compressor shown in FIG. 10, along line 13—13.
Figure 14:
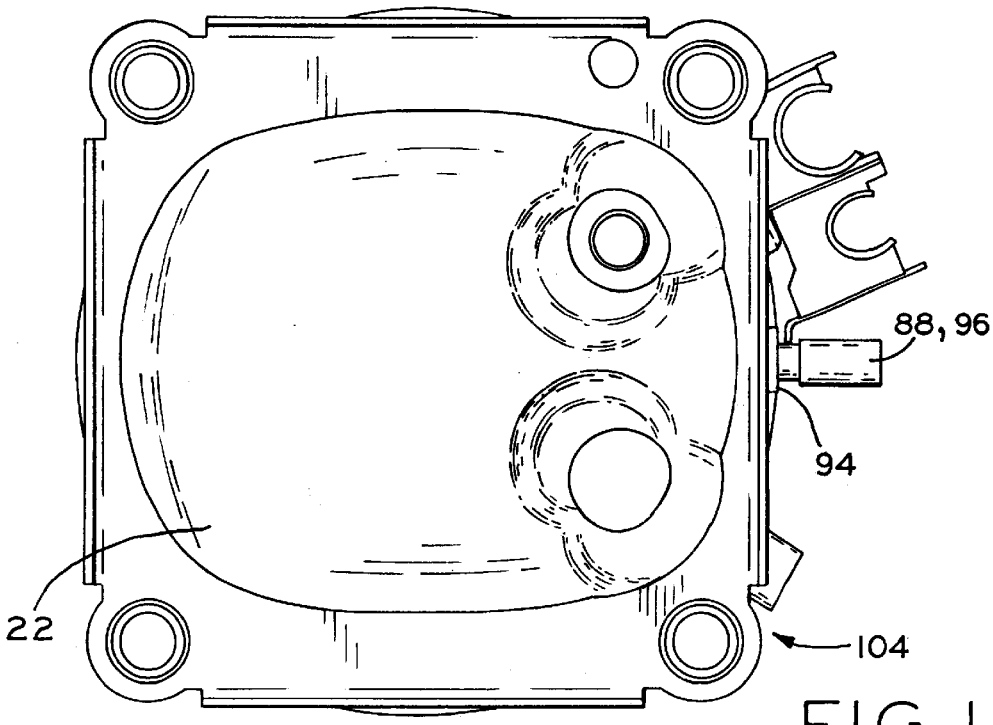
FIG. 14 is a bottom view of the compressor shown in FIG. 10.
Figure 15:
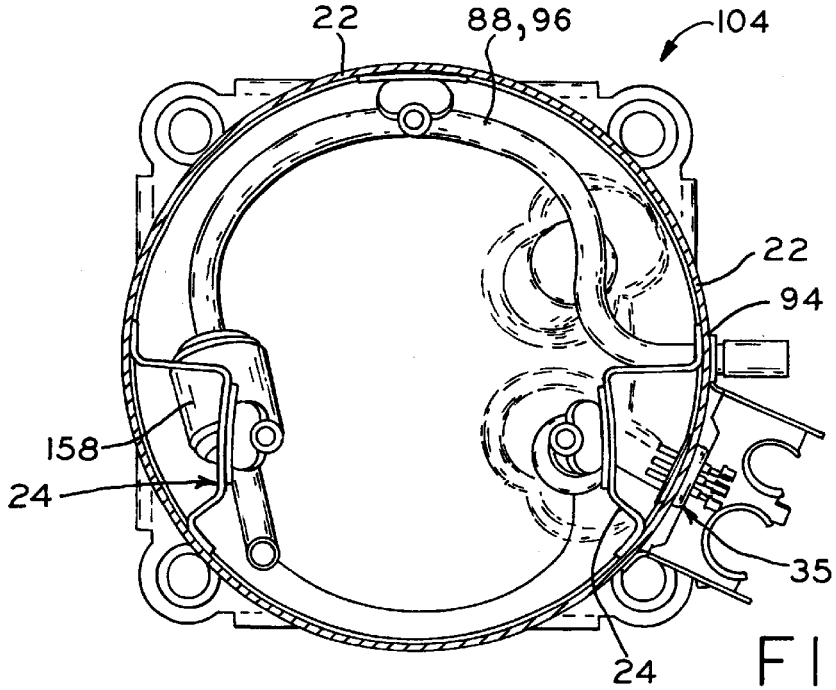
FIG. 15 is a sectional view of the compressor shown in FIG. 10, along line 15—15, in which the motor and compression mechanism are not shown.
Figure 19A:
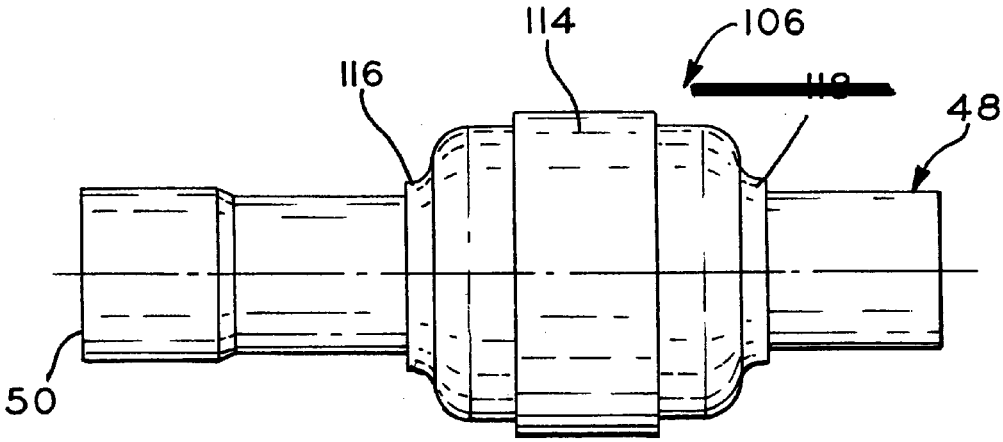
FIG. 19A is a side view of the suction muffler of the compressor shown in FIG. 10.
Figure 19B:
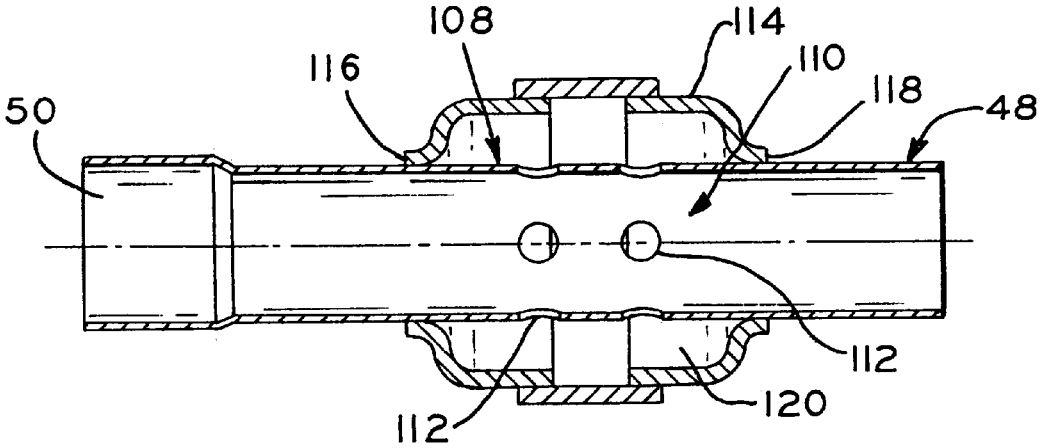
FIG. 19B is a longitudinal sectional view of the suction muffler shown in FIG. 19A.

Referring to FIGS. 10, 11 and 12, compressor assembly 104 is a second embodiment of a reciprocating piston compressor assembly according to the present invention. Compressor 104 is a 3-ton compressor having a displacement of approximately 3.5 cubic inches. Compressor assembly 104 is similar in structure and operation to compressor assembly 20 except as described herein. Suction pressure gases enter compressor housing 22 through inlet 45 which is held securely within aperture 47 located in the side of housing 22 by welding, brazing or the like. As illustrated in FIGS. 10 and 13, inlet 45 is substantially aligned with suction inlet 46 located in one side of motor end cap 44 such that as suction pressure refrigerant is drawn into housing 22, a portion of the fluid enters inlet 46 into motor end cap 44. The remainder of the suction pressure fluid circulates within housing 22. The suction pressure refrigerant which flows into motor end cap 44, flowing over the top of motor 28 to cool the top end thereof. The refrigerant exits motor end cap 44 through suction tube 48 which leads to inlet 50 of suction muffler 106 as shown in FIGS. 12, 19A, and 19B. Suction muffler 106 is of a Helmholtz type having tube 108, which is part of suction tube 48, provided with a plurality of axially-spaced hole arrangements 110 therealong. Tube 48 is constructed from a material such as steel or the like and has a diameter of approximately ¾ inch. Each arrangement of holes 10 comprises two pairs of holes 112, the holes in each arrangement are cross drilled so that the holes are equally radially distributed about the circumference of tube 108. Notably, each hole arrangement 110 is substantially equally spaced along the longitudinal axis of tube 108. The number and size of holes 112 is dependant on the frequencies which are being attenuated. In this embodiment, holes 112 are formed in tube 108 by any suitable manner such as being punched or drilled and have a diameter of 3/16 inch to attenuate noise created by the operation of valve arrangement 74 and the primary pumping frequency. Tube 108 is surrounded by shell 114 having ends 116 and 118 which are sealed to the exterior surface of tube 108 to create chamber 120 around hole arrangements 110 (FIGS. 12, 19A, and 19B). Shell 114 is made from any suitable material such as steel and has a volume of 1.16 cubic inches which is also dependant on the frequencies in the primary pumping pulse being attenuated.

As with compressor assembly 20, the suction gas exits suction muffler 106 and enters cylinder head assembly 122 which includes cylinder head 66 covering a head spacer disposed between valve plate 78 and cylinder head 66, as described in more detail below (FIG. 12).

Cylinder head 66 and the head spacer together define enlarged suction chambers 126 and discharge chamber 128 therein which help to alleviate efficiency problems experienced with some reciprocating compressors. These problems include discharge pressure gas within discharge chamber 128 not readily exiting cylinder head 66, resulting in a pressure buildup in discharge chamber 128 during compressor operation. Consequently, cylinder bore 40 may not be fully exhausted of discharge pressure gas at the end of the compression cycle because the buildup of gas within discharge chamber 128 inhibits the accommodation therein of gas being exhausted thereinto from cylinder 40. Because gas from the previous compression cycle has not been fully exhausted from cylinder bore 40, less suction pressure gas can be drawn into cylinder 40 during the next compression cycle. Thus, the efficiency of the compressor is compromised. Moreover, the temperature of gas on the discharge side of the system may become excessively high as more and more work is expended on the gas already at discharge pressure.

Figure 18A:
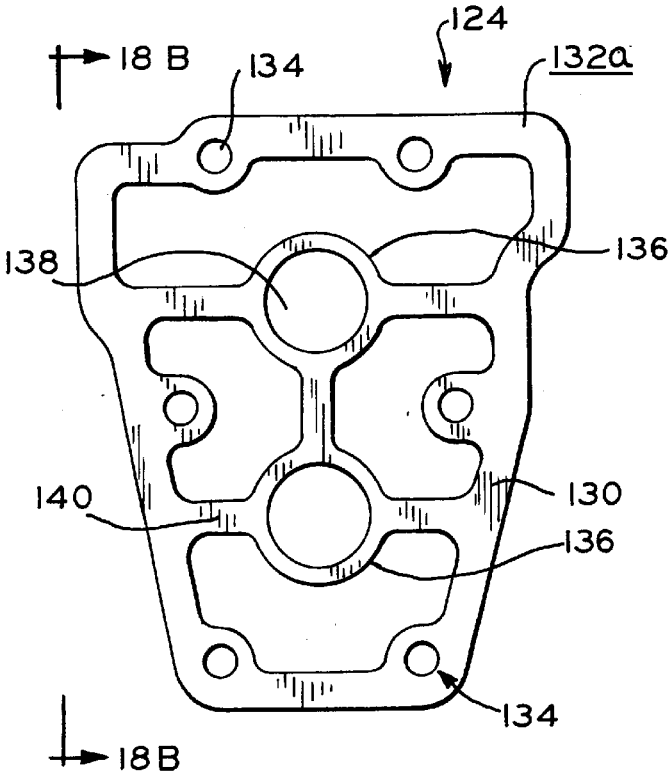
FIG. 18A is a plan view of one embodiment of the head spacer included in the compressor shown in FIG. 10.
Figure 18B:
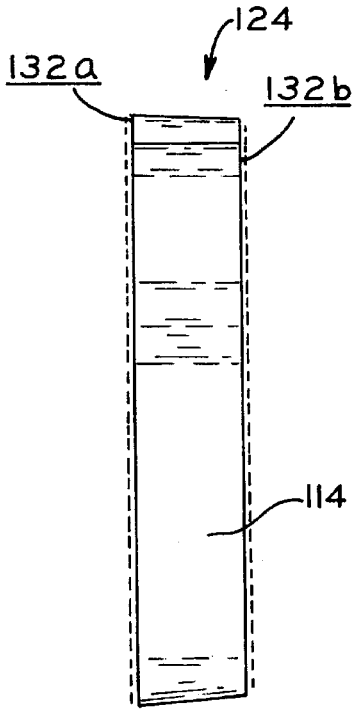
FIG. 18B is a side view of the head spacer shown in FIG. 18A.

A first embodiment of head spacer 124 is shown in FIGS. 18A and 18B and provides means for enlarging suction chamber 126 and discharge chamber 128 (FIG. 12). Spacer 124 includes body portion 130 having a substantially open interior extending between first planar end surface 132*a* and substantially parallel second planar end surface 132*b* with fastener apertures 134 therein. Head spacer 124 may be constructed from any suitable material including metal or plastic. Cylindrical portions 136 define suction passageways 138 therethrough, and are connected to body portion 130 by bridge portions 140. The remainder of the substantially open interior of body portion 130 partially defines discharge chamber 128, and cooperates with cylinder head 66 to form an enlarged discharge chamber 128. Head spacer 124 thereby cooperates with cylinder head 66 to effectively increase the volume of discharge chamber 128 of cylinder head assembly 122, in order to prevent the buildup of discharge pressure gas within discharge chamber 128. Discharge chamber 128 therefore may accommodate a greater volume of discharge gas, allowing substantially all of the discharge gas to be exhausted from cylinder bores 40 during the operation of compressor 104, improving the efficiency of compressor 104. When assembling cylinder head assembly 122, first and second end surfaces 132*a*, 132*b* of head spacer 124 are sealed with the adjacent surfaces of cylinder head 66 and valve assembly 78, respectively, by gaskets (not shown). Compressor assembly 20 of the first embodiment is not provided with head spacer 124 due to a lack of clearance within housing 22, however, if space were available, head spacer 124 would improve the efficiency of compressor 20 in the same manner as described above. As noted above, the discharge chamber within the head generally acts as an expansion chamber muffler, and enlargement of this chamber generally improves its effectiveness as such.

Figure 18C:
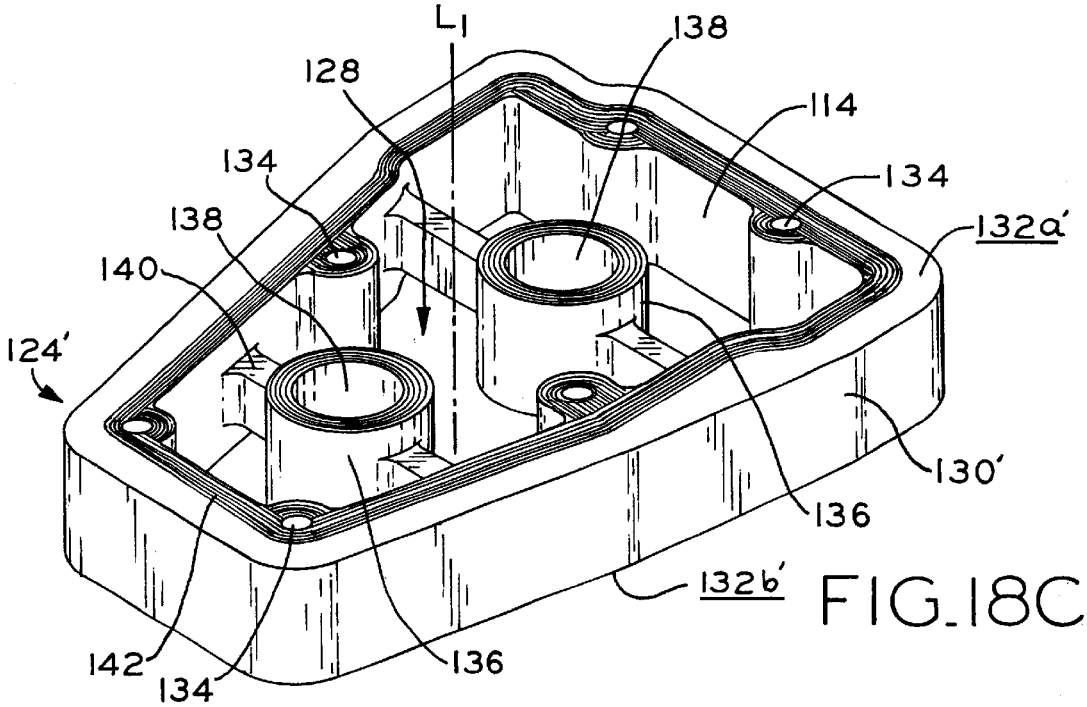
FIG. 18C is a perspective view of an alternative embodiment of the head spacer included in the compressor shown in FIG. 10.
Figure 18D:
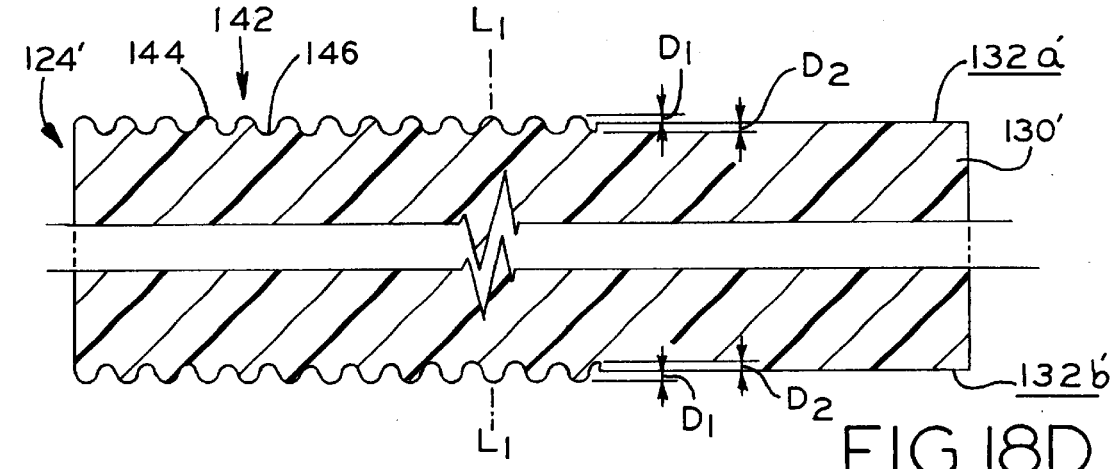
FIG. 18D is a partial sectional view of the head spacer of FIG. 18C, showing the spacer prior to installation.
Figure 18E:
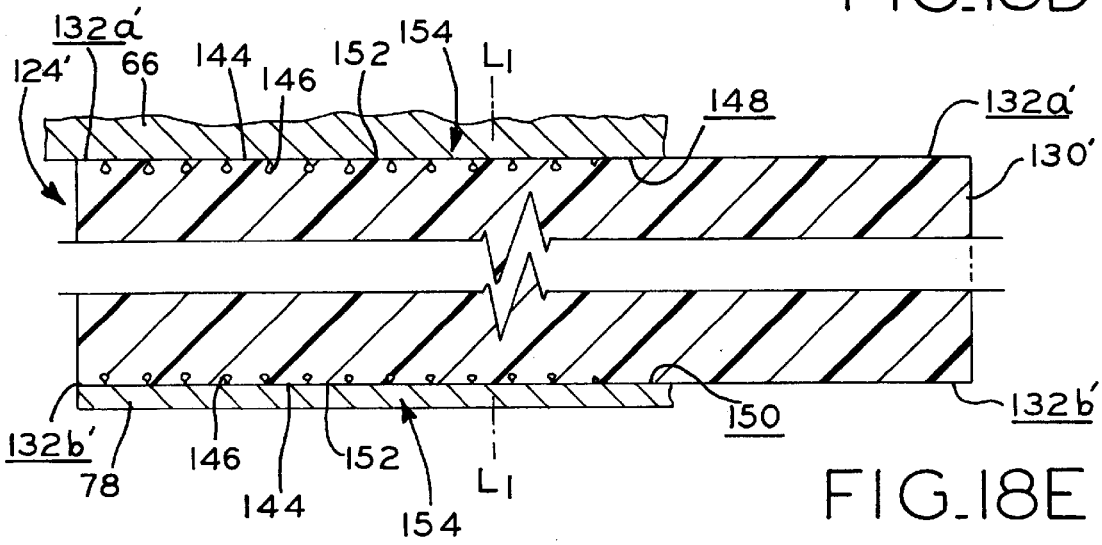
FIG. 18E is a partial sectional view of the head spacer of FIG. 18D, showing the spacer installed.

The second embodiment of head spacer 124', shown in FIGS. 18C–18E, which is provided with an alternative sealing method between surfaces 132*a*' and 132*b*' of spacer 124' and valve plate assembly 78 and cylinder head 66. Spacer 124' may be formed of an injection-molded plastic. The plastic material has a coefficient of thermal expansion which is substantially similar to the metal components of cylinder assembly 122, including cylinder block 41 and cylinder head 66, such that head spacer 124' may shrink and/or expand at substantially the same rate as cylinder block 41 and cylinder head 66. The plastic material of which head spacer 124' is formed provides insulation against thermal conduction between discharge chamber 128 and suction chamber 126. One suitable plastic for head spacer 124' is PLENCO® a phenolic molding compound, Product No. 6553, available from Great Lakes Plastics, 7941 Salem Rd., Salem, Mich., which, after curing, has a coefficient of linear expansion of $12\times10^{-6}$ mm/mm/° C. (25° C. to 190° C.). (PLENCO® is a registered trademark of Plastics Engineering Co., 3518 Lakeshore Rd., Sheboygan, Wis.)

Referring to FIGS. 18D and 18E, the alternative method of accomplishing the above described sealing engagement of head spacer 124' includes providing a series or plurality of concentric, continuous ridges 142 on substantially parallel planar end surfaces 132*a*', 132*b*' of head spacer 124' disposed around the periphery of body portion 130' having corresponding and alternating ridge tips 144 and valleys 146. As may be seen in FIGS. 18C, ridge tips 144 and valleys 146 are continuous, and circumferentially extend around the periphery of first and second end surfaces 132*a*', 132*b*' of head spacer 124'. Referring again to FIG. 18D, ridges 142 are shown in an undeformed state, where tips 144 extend a first distance $D_1$ from each of first and second planar end surfaces 132*a*', 132*b*', and valleys 146 extend a second distance $D_2$ from each of planar first and second end surfaces 132*a*', 132*b*' opposite tips 144. As shown in FIG. 18D, first distance $D_1$ is approximately twice the length of second distance $D_2$, but may vary substantially. First and second end surfaces 132*a*', 132*b*' lie in planes perpendicular to a line $L_1$-$L_1$, which defines a central axis of head spacer 124'. When head spacer 124' is placed between valve plate 78 and cylinder head 66 during assembly of cylinder head assembly 122, and a compressive load is exerted upon cylinder head assembly 122, for example, by torquing down fasteners such as bolts (not shown) to tighten cylinder head 66, ridge tips 144 plastically deform to a deformed state as shown in FIG. 18E.

In the deformed state shown in FIG. 18E, ridge tips 144 are deformed by the planar interfacing surfaces 148, 150 of cylinder head 66 and valve plate 78, respectively, into a generally mushroom shape in which portions of ridge tips 144 extend into adjacent valleys 146, and portions of adjacent ridge tips 144 may contact one another to form sealing surface 152 between head spacer 144 and cylinder head 66, as well as between head spacer 124' and valve plate 78. Sealing surfaces 152, created by the deformation of ridge tips 124', define labyrinth seals 154. Labyrinth seals 154 are tortuous arrangements of deformed ridge tips 144 which seal discharge gas within discharge chamber 128 at the interface of head spacer 124' and cylinder head 66, as well as at the interface of head spacer 124' and valve plate 78. Labyrinth seals 154 sufficiently seal head spacer 124' between cylinder head 66 and valve plate 78, obviating the need for additional seals. It may be seen from FIG. 18E that the interfacing surfaces of cylinder head 66 and valve plate 78 respectively lie in first and second planes which are respectively substantially coincident with the third and fourth planes defined by first and second end surfaces 132*a*', 132*b*' of head spacer 124', respectively, when the fasteners are tightened to torque cylinder head 66 down onto head spacer 124', valve plate 78, and cylinder block 41, and causing ridge tips 144 to deform to form labyrinth seals 154.

Generally, during the assembly of compressor 104 and cylinder head assembly 122, cylinder head 66, valve plate 78, and head spacer 124 are positioned respectively adjacent one another, in a stacked arrangement on cylinder block 41, such that cylinder bores 40 are covered, and fastener apertures 134 in head spacer 124 and the foregoing components are aligned. Fasteners are then inserted through apertures 134 in cylinder head assembly 122 to engage cylinder block 41 and exert a compressive load on cylinder head assembly 122. This tightens cylinder head assembly 122 down onto cylinder block 41, which, seals adjacent surfaces 132*a*, 132*b* and cylinder head 66 and valve plate 78, respectively. In the case of the alternative sealing method, ridge tips 144 of head spacer 124' are compressed from the undeformed state shown in FIG. 18D to the deformed state shown in FIG. 18E, providing sealing surfaces 152 and labyrinth seals 154 between head spacer 124' and cylinder head 66, and between head spacer 124' and valve plate 78.

The flow of gas through compressor assembly 104 is similar to that of compressor assembly 20. The suction pressure gas flows into suction chamber 126 defined in cylinder head 66 and head spacer 124. From chamber 126, the suction pressure gas passes through suction ports 80 (FIG. 8A) of valve plate 78 into cylinder bores 40 where the refrigerant is compressed to a substantially higher discharge pressure. The compressed fluid flows through discharge ports 81 of valve plate 78 into discharge chamber 128 also defined by cylinder head 66 and head spacer 124. The discharge pressure gas in chamber 128 exits cylinder head assembly 122 through discharge outlet 86 illustrated in FIG. 10 and enters first muffler 156 (FIGS. 10, 11, 12 and 20).

Figure 20:
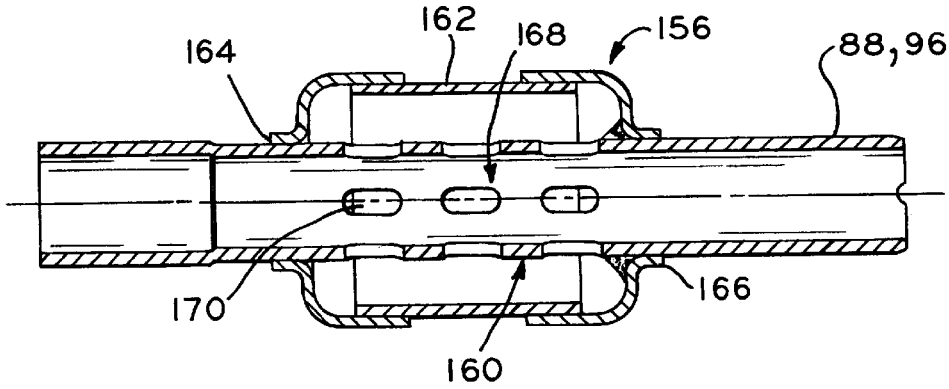
FIG. 20 is a longitudinal sectional view of the first discharge muffler of the compressor shown in FIG. 10.

Referring now to FIG. 20, it can be seen that first muffler 156 comprises tube 160 having a diameter of approximately ⅝ inch, which may be a part of discharge tube 88. Tube 160 extends through generally cylindrical shell 162 having first and second ends 164 and 166. Shell ends 164 and 166 are sealed to the exterior surface of tube 160 and within shell 162, tube 160 is provided with a plurality of hole arrangements 168. Each arrangement of holes 168 comprises three pairs of holes 170, the holes in each arrangement may be cross drilled so that the holes are equally radially distributed about the circumference of tube 160. In this embodiment, each hole 170 is formed in the shape of an ellipse having an area of 0.0345 square inches. Notably, each arrangement of holes 168 are substantially equally spaced along the longitudinal axis of tube 160. It is understood that holes 170 may be of any shape and size that adequately attenuate noise in the discharge pressure refrigerant.

Figure 21:
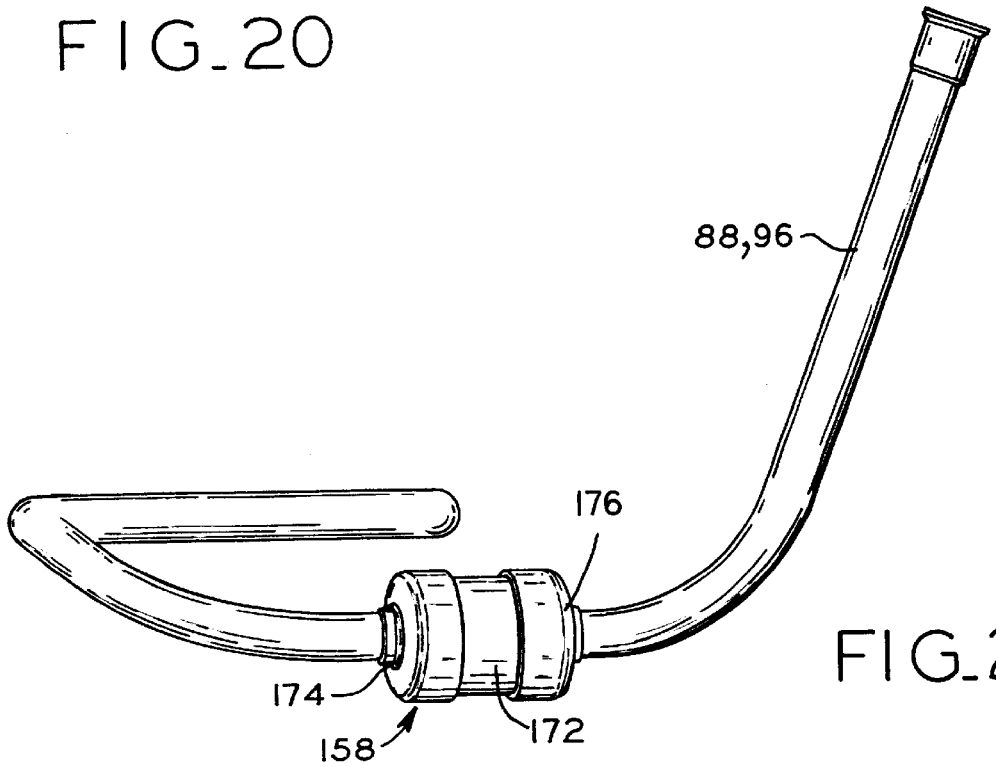
FIG. 21 is a view of the discharge tube of the compressor shown in FIG. 10, the discharge tube including the second discharge muffler.
Figure 22:
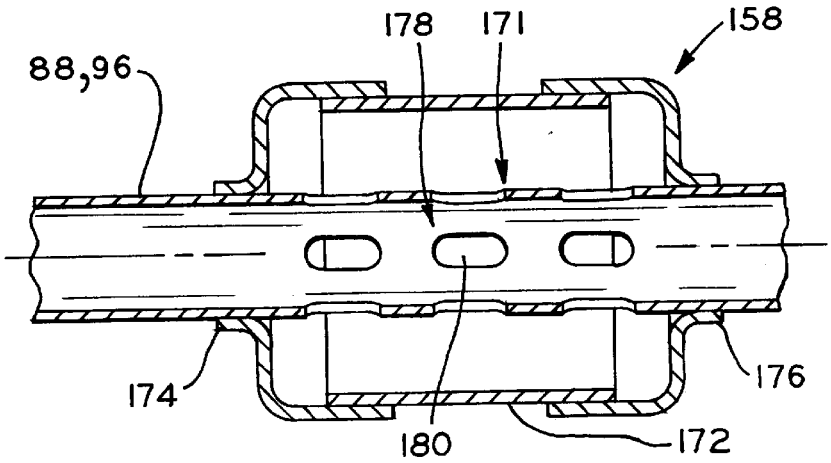
FIG. 22 is a longitudinal sectional view of the second discharge muffler of the compressor shown in FIG. 10.

As with compressor 20, referring now to FIG. 21, there is shown discharge tube 96 which may be part of discharge tube 88 both of which being approximately ½ inch in diameter and constructed from steel. Located in discharge tube 96 is second muffler or resonator 158 as shown in greater detail in FIG. 22. Like the first muffler 156, second resonator 158 comprises part of a tube which extends through a shell, the tube within the shell having a plurality of spaced hole arrangements. As shown in FIG. 22, tube 171 extends through shell 172 which has first and second ends 174 and 176. Ends 174 and 176 of the generally cylindrical shell 172 are sealed to the exterior surface of tube 171. A plurality of hole arrangements 178 are axially spaced along tube 171 within shell 172, each arrangement of holes 178 comprising a plurality of holes 180. As described above, holes 180 may be cross drilled or punched through tube 171, thereby equally radially distributing the holes about the circumference of the tube. Holes 180 are of similar size and shape to holes 170 of first muffler 156. Second muffler 158 is spaced from first muffler 156 along discharge tube 96 a specific distance to better attenuate noises in the primary pumping pulse in the discharge pressure refrigerant as will be described hereinbelow.

It is to be noted that although first and second mufflers 156 and 158 depicted are of the Helmholtz type, it is to be understood that the present invention may be practiced using first and second mufflers which are merely expansion chambers. Such mufflers would not have a tube extending longitudinally through the muffler, but rather would have a tube which enters into the expansion chamber, which may be defined by shells 162 and 172, and a tube which exits from the shell, the interior of the mufflers being open and hollow.

Compression devices such as hermetic compressors 20 and 104 (FIGS. 1, 2, and 10–12) are driven at a particular frequency which correlates directly with the speed at which driving motor 28 disposed within compressor shell or housing 22 rotates. As described above, motor 28, which is well known in the art, has rotor 34 which is electromagnetically induced into rotation by current directed through windings 33 in stator 32. Shaft 36 extending longitudinally through rotor 34 drives compression mechanism 30. Thus, the frequency of the pressure pulses will be directly correlated to the speed of motor 28. The speed of motor 28 in compressors 20 and 104 is approximately 3450 to 3500 rpm which directly correlated to the frequency of the alternating current which powers motor 28. Thus, the frequency of the pulse which is associated with the frequency of the alternating current which powers motor 28, can be predicted with accuracy because the cycle of the electrical power is a known quantity. For example, in the United States, electrical power of the alternating current type is normally provided at a 60 hertz cycle.

The cyclical pulsations in the refrigerant which result from its compression within compression mechanism 30 and which is directly and most elementally correlated to frequency of the electrical power which drives motor 28, may be referred to as the primary pumping frequency within the primary pumping pulse. The primary pumping frequency will also be affected by the number of compression chambers which are compressing the fluid directed through discharge tube 88. For example, a reciprocating piston type compressor may have a single cylinder and piston. Thus, the primary pumping frequency will be a factor of one times the frequency at which electrical power is provided to the motor. Similarly, as is the case with compressors 20 and 104, a reciprocating compressor which has two cylinders 40 and pistons 38 driven off common shaft 36 will have a primary pumping frequency which is twice that of the single piston type compressor. Accordingly, a three piston type compressor will have a pumping frequency which is three times that of the single piston type compressor, and so on.

Figures 23A, 23B, 23C:
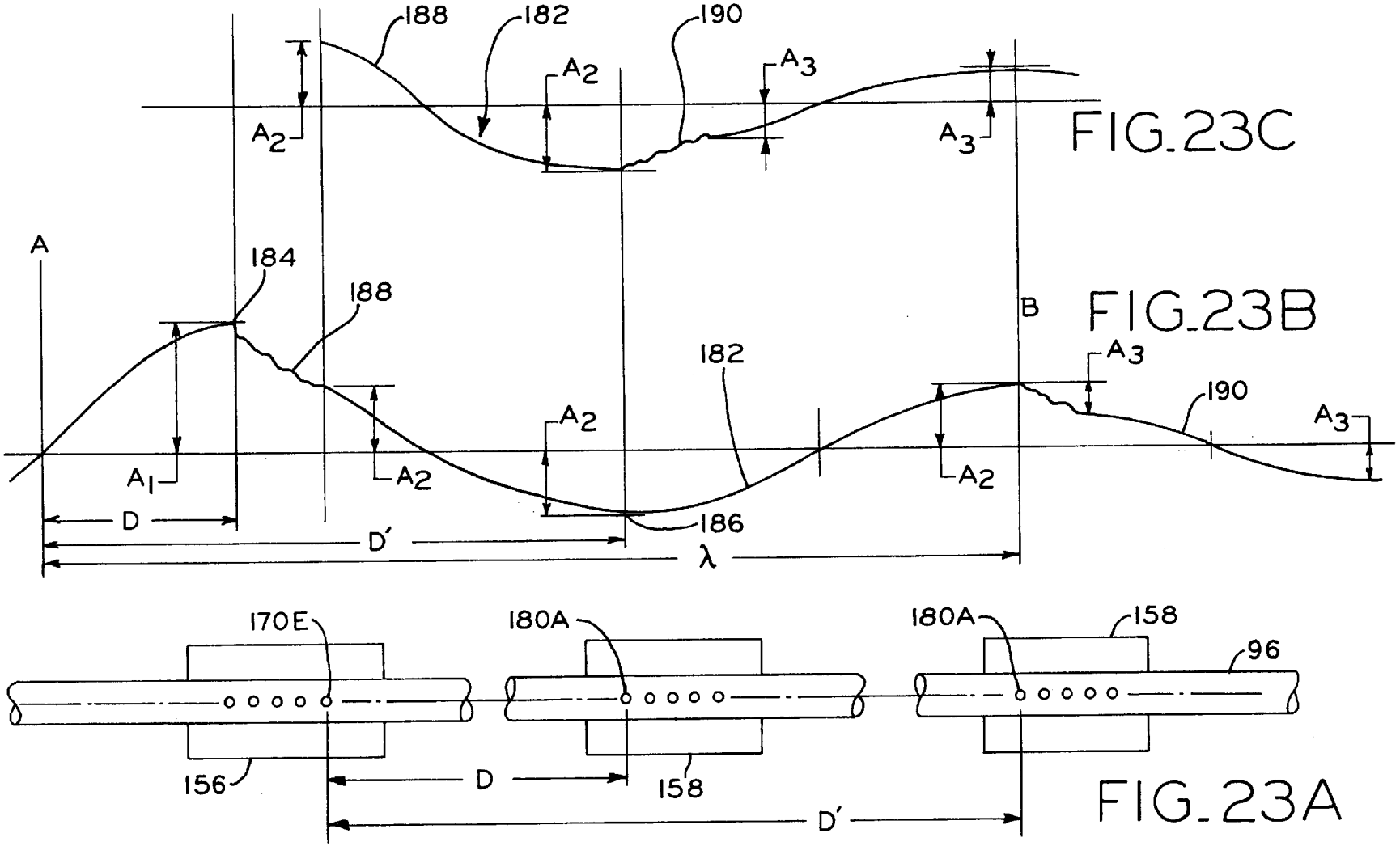
FIG. 23A is a schematic view of the primary pumping pulse in the discharge refrigerant in the compressor of FIG. 10 for various distances between the first and second mufflers of that compressor.
FIG. 23B is a schematic view of the amplitude of the primary pumping pulse in the discharge refrigerant in the compressor shown in FIG. 10, after passing through the first and second mufflers spaced a distance D.
FIG. 23C is a schematic view of the amplitude of the primary pumping pulse in the discharge refrigerant in the compressor shown in FIG. 10, after passing through the first and second mufflers spaced a distance D'.

The primary pumping frequency wave form in the primary pumping pulse in the discharge pressure refrigerant has both a standing or nonmoving component as well as a traveling component, each of which having different amplitudes to produce different sounds or noises. The amplitude of the standing wave is much greater than the traveling wave and has fixed peaks and valleys as depicted in FIG. 23B. The traveling wave (not shown) has a much smaller amplitude that produces much less noise during compressor operation than the standing wave. The amplitude of the traveling wave is reduced as the wave moves along a muffler or resonator, no specific placement of the muffler is required because the points of amplitude maximum absolute value (i.e., the points of lowest minimum or highest maximum amplitude) of the primary pumping frequency are not fixed. However, in order to effectively reduce the amplitude of the frequency of the standing wave, the muffler must be placed at the fixed points of amplitude maximum absolute value (i.e, the points of lowest minimum or highest maximum amplitude) of the primary pumping frequency wave form.

A single Helmholtz muffler is capable of reducing the amplitude of very specific frequencies, however, only in a narrow band width. Expansion mufflers are capable of reducing the amplitude of frequencies in a wide band width, however, the amplitudes attenuated are much lower than a Helmholtz resonator. In order to effectively reduce the noise produced during compressor operation by the primary pumping pulse, a single muffler and the compressor discharge chamber, or a pair of mufflers, are spaced along the discharge tube, at specifically calculated points in the primary pumping frequency wave form as is discussed below.

In accordance with the present invention the first and second mufflers of both compressors 20 and 104 are placed in series along the discharge tube assembly at a specific distance from one another, that distance corresponding to that distance between the expected minimum and maximum amplitudes of the primary pumping frequency wave form in the refrigerant. In compressors 20 and 104, a problematic or noisy frequency is produced by a discharge pulse within the primary pumping pulse having a frequency of approximately 1400 hertz created by operation of discharge valve 84 of valve assembly 74. Accordingly, discharge chamber 76 in cylinder head 66 and mufflers 100, 156 and 158 are tuned and axially spaced along discharge tube 88 to reduce the amplitude of the discharge pulse at a frequency of 1400 hertz. It is understood that the mufflers are tuned for the use of refrigerant R22, if an alternative refrigerant were used in compressors 20 and 104, the mufflers would have to be retuned.

The first muffler, which is essentially discharge chamber 76 in cylinder head 66 of compressor 20, and first muffler 156 of compressor 104, which may be positioned at any point downstream of head 66, establish an initial point from which wavelength λ is measured. With reference now to FIG. 23B, wavelength λ is represented by a sine wave which begins at point A and ends at point B. Although FIG. 23B shows that point A coincides with a node or a point of minimum amplitude of the wave, it is to be understood that this placement of the first muffler need not be at such a node. In any case, the amplitude of the pressure wave exiting the first muffler will be reduced, at that frequency, relative to its amplitude prior to entering the first muffler. Thus wave form 182 extends for one complete wavelength λ between points A and B. As depicted in FIG. 23B, where wave form 182 has a node coinciding with point A, one half of wavelength λ also occurs at a node, as does the point of wave form 182 which coincides with point B. At one quarter and three quarters the length of wavelength λ from point A, it can be seen that wave form 182 has maximum amplitudes 184 and 186. Those of ordinary skill in the art will recognize that at any other odd multiple of one quarter λ, wave form 182 will also be at a point of maximum absolute amplitude value. As shown in FIG. 23B, distance D is that distance from point A to the point of maximum amplitude 184 at one quarter λ and distance D' is the distance between point A at maximum amplitude 186 at three quarter λ. These distances D and D' correspond to the spacing between the first and second muffler as illustrated in FIGS. 23A. The mufflers in FIG. 23A are represented as mufflers 156 and 158 of compressor 104, however, it is understood that mufflers 76 and 100 of compressor 20 could be represented in place of mufflers 156 and 158, respectively. Wave form 182 demonstrates a frequency and general character of a pressure wave, the relationship between the wave form being that frequency of the primary pumping frequency. Thus the structure of the present invention can be established with help of the following equation:

$$c/f=\lambda$$

where c equals the speed of sound in the compressed refrigerant; f equals the primary pumping frequency; and λ is the wavelength.

The operating speed of compressors 20 and 104 running on a 60 hertz electrical input is 58 hertz. Compressors 20 and 104 being two cylinder type piston compressors, the primary pumping frequency is 2 times 58 hertz which approximately equals 116 hertz. This is incorporated into the above equation. The speed of sound in refrigerant is 7200 inches per second, however, this may vary with temperature and pressure.

The resulting λ is 62 inches. The point of maximum amplitude 184 at one quarter λ is thus 15½ inches. Thus, in order to further attenuate the amplitude of the pumping pulse in the discharge fluid, second muffler 100 or 158 should be located at a distance D of 15½ inches from first muffler 76 or 156, respectively. Alternatively, second muffler 100 or 158 can be located at distance D' from first muffler 76 or 156, this distance corresponding to three quarters of the length λ or 46½ inches. Thus, by means of the present invention, the second muffler, by being placed at a particular distance corresponding to points of maximum amplitude of the pressure pulses in the primary pumping frequency, from the first muffler, the noise associated with the primary pumping frequency can be effectively and further attenuated vis-a-vis previous systems having but a single discharge muffler. The two mufflers of each compressor do not necessarily have to be precisely placed at 15½ inches from each other and may be placed a distance of approximately 12-20 inches apart before reaching a higher discharge pulse near a node.

With reference to mufflers 156 and 158 of the Helmholtz type, as shown in FIG. 23A, distances D and D' shall be most effectively extended from the furthest downstream arrangement of holes 170E in first muffler 156 and furthest upstream arrangements of holes 180A in second muffler 158. By so arranging the first and second Helmholtz type mufflers 156 and 158, the greatest attenuation of the primary pumping pulse can be achieved by the first muffler, the second muffler having the greatest opportunity then to further attenuate the pumping pulse which reaches it.

Referring again to FIG. 23B as discussed above, wave form 182 represents a sine wave, which may be representative of the pressure pulse between the two mufflers, demonstrating the wavelength and points of maximum amplitude 184 and 186 along wavelength λ. The diminishing wave form is further shown in FIGS. 23B has a first amplitude A1 before entering first mufflers 76 and 156. After passing through the first mufflers, the amplitude of waveform 182 at point 184 is reduced at 188 to having an amplitude of A2 (FIG. 23B). With second mufflers 100 and 158 located at distance D from first mufflers 76 and 156, respectively, it can be seen in FIG. 23C that wave form 182 will enter second mufflers 100 and 158 having an amplitude of A2 and will be reduced as at 190 to having an amplitude of A3 upon exiting the second mufflers. Similarly, with second mufflers 100 and 158 located at a distance D' corresponding to point of maximum amplitude 186, at three quarter λ, it can be seen that the amplitude A2 of wave form 182 will be reduced as the refrigerant passes through second mufflers 100 and 158, to a modified wave form shown at 190 having a reduced amplitude A3 (FIG. 23B).

Although compressors 20 and 104 depict that first muffler 76, 156 and second mufflers 100, 158 are packaged within housing 22, it is to be understood that the separation of the first and second mufflers may be achieved in a discharge line external to housing 22. The placement of the first and second mufflers along discharge tube 96 within housing 22 improves the packaging characteristics of compressors 20 and 104, but is not a necessary aspect of the present invention.

Figure 5:
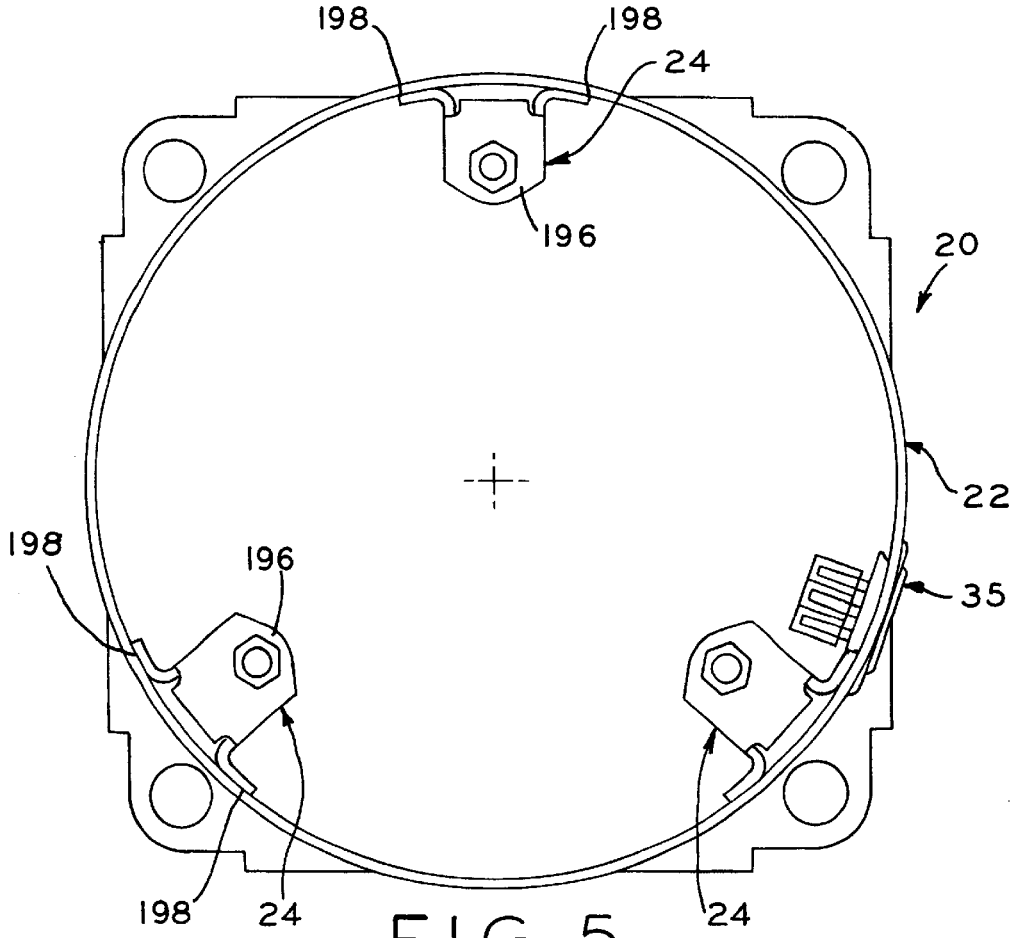
FIG. 5 is a sectional view of the compressor shown in FIG. 1, along line 5—5.
Figure 6:
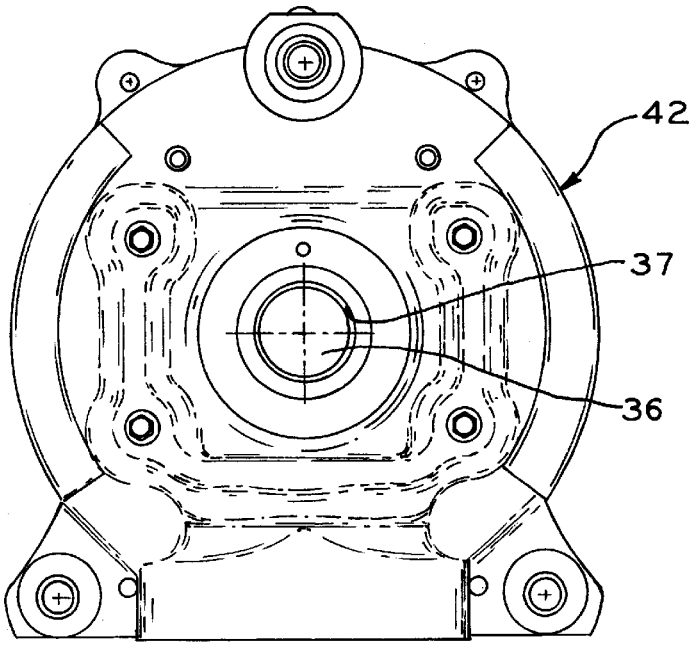
FIG. 6 is a bottom view of the crankcase of the compressor shown in FIG. 1.
Figure 16:
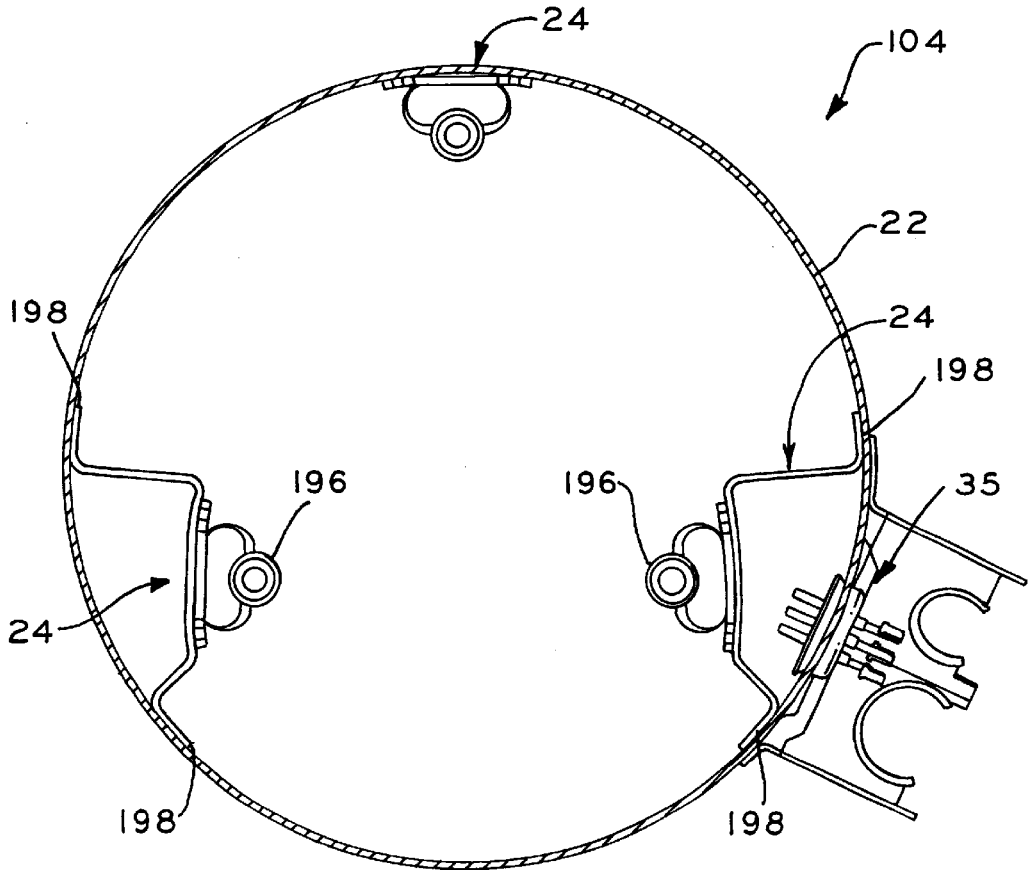
FIG. 16 is a sectional view of the compressor shown in FIG. 10, along line 16—16, in which the motor, compression mechanism, bottom housing, and discharge tube are not shown.
Figure 17:
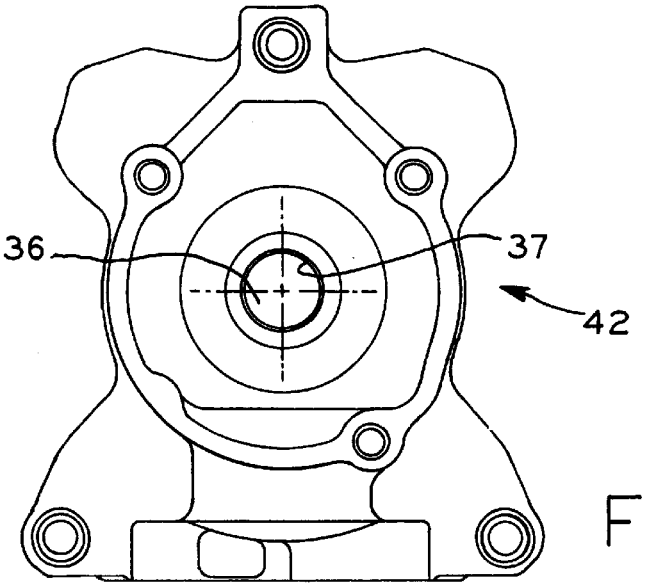
FIG. 17 is a bottom view of the crankcase of the compressor shown in FIG. 10.
Figure 24:
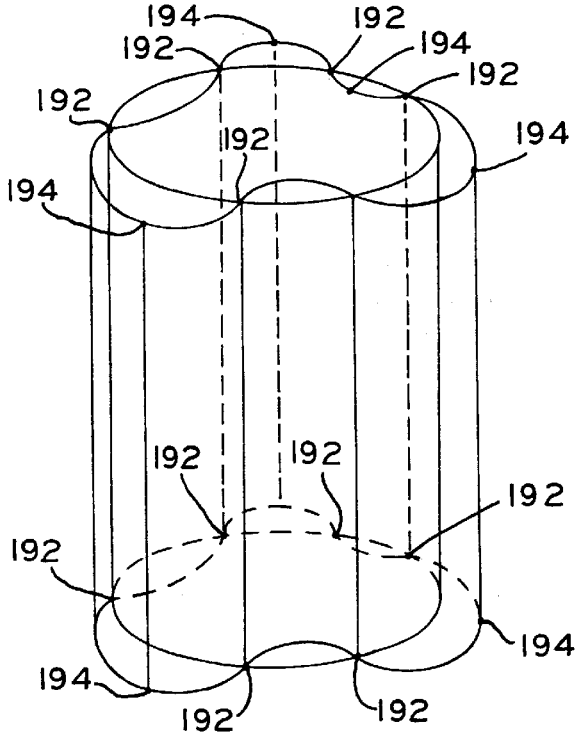
FIG. 24 is a perspective view of a compressor housing showing the formation of a vibration at a natural frequency.

During the operation of compressor assemblies 20 and 104, the cylindrical shape of housing 22 has several natural resonant frequencies that produce loud, pure tones which are undesirable. In order to reduce or eliminate these frequencies, resilient mounts 24 illustrated in FIGS. 5 and 16 are welded to housing 22 so as to span a node and an anti-node of the wave form. Mounts 24 are secured at 196 to crankcase 42 and at 198 to the inner surface of housing 22 by means such as weldment. The natural frequencies associated with housing 22 may have any number of nodes. The most problematic or noticeable frequency 193 is one in which there are six naturally occurring nodes 192 and anti-nodes 194 circumferentially spaced around housing 22 at equal distances (FIG. 24).

Figure 25:
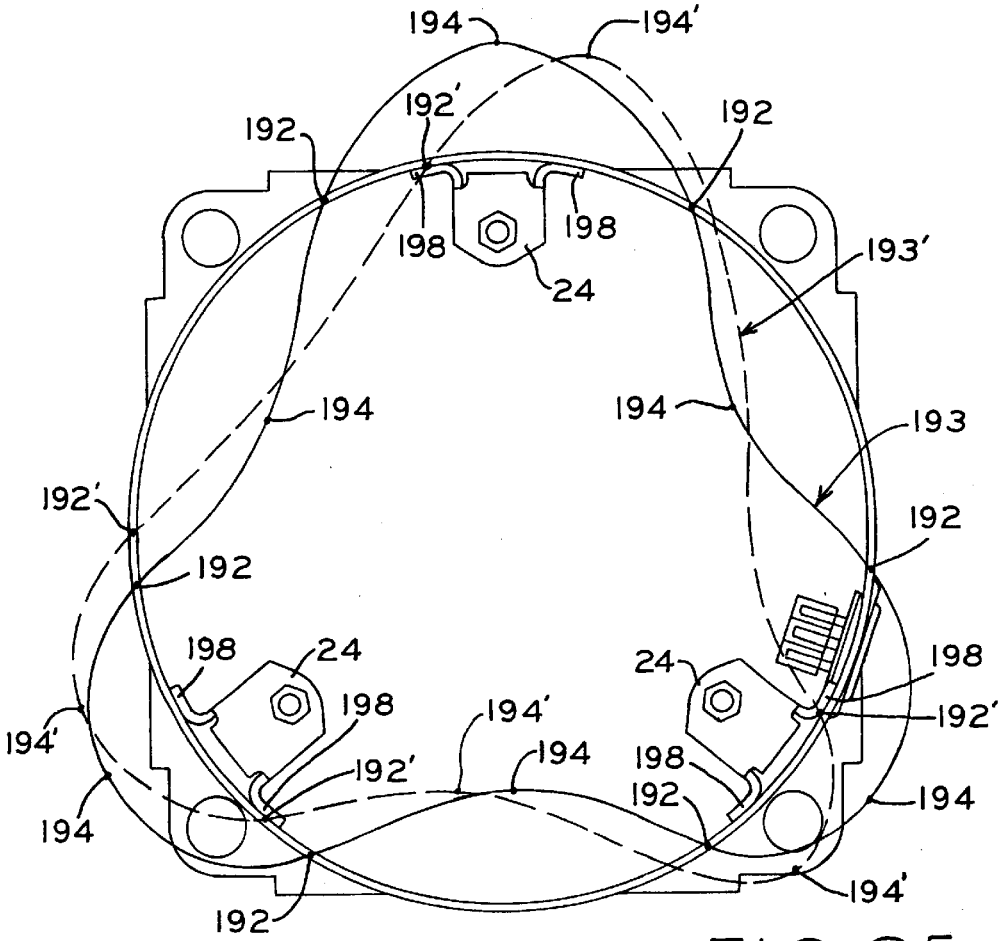
FIG. 25 is a sectional view of the compressor shown in FIG. 5, schematically illustrating a natural frequency wave form and a forced frequency wave form in the compressor housing.

To reduce the amount of noise produce by this natural frequency, the nodes and anti-nodes must be forced to an alternative position by specifically securing mounts 24 to housing 22 at points which are unequally distributed about the circumference of housing 22 and which do not coincide with naturally occurring nodes. The forced frequency 193' produced by mounts 24 is illustrated in FIG. 25 and is represented by dashed lines. It is critical that mounts 24 are unequally distributed about the circumference of housing 22 because if they were equally distributed, forced nodes 192' and anti-nodes 194' would fall on those of natural frequencies and thus the amplitude of the natural frequency would not be attenuated.

Referring to FIG. 25, one of ends 198 of each mount 24 is welded to the inside surface of housing 22 at positions offset from naturally occurring nodes 192. The weld forces nodes 192', dampening the vibrations in housing 22 created by the natural frequency. The weld at opposite end 198 of mount 24 is then located so as to force anti-node 194' or points of maximum amplitude between two nodes. Forced anti-nodes 194' are then free to vibrate and cause tones which produce noise. These tones, however, are at a much lower amplitude which do not produce the same objectionable noise of the natural resonant frequencies.

While this invention has been described as having exemplary designs, the present invention may be further modified within the spirit and scope of this disclosure. Therefore, this application is intended to cover any variations, uses, or adaptations of the invention using its general principles. For example, aspects of the present invention may be applied to compressors other than reciprocating piston compressors. Further, this application is intended to cover such departures from the present disclosure as come within known or customary practice in the art to which this invention pertains.

What is claimed is:

1. A reciprocating piston compressor, comprising:

a cylinder block having a cylinder bore;

a piston reciprocatingly disposed in said cylinder bore;

a cylinder head connected to said cylinder block and partially defining a suction chamber into which gas is received and from which the gas exits into said cylinder bore substantially at a suction pressure, said cylinder head partially defining a discharge chamber into which gas is received from said cylinder bore and from which the gas exits substantially at a discharge pressure;

a valve plate having a suction port through which said cylinder bore and said suction chamber fluidly communicate, and a discharge port through which said cylinder bore and said discharge chamber fluidly communicate;

a suction check valve disposed over said suction port and past which gas flows from said suction chamber to said cylinder bore, flow from said cylinder bore to said suction chamber being inhibited by said suction check valve;

a discharge check valve disposed over said discharge port and past which gas flows from said cylinder bore to said discharge chamber, flow from said discharge chamber to said cylinder bore being inhibited by said discharge check valve; and a spacer disposed between said valve plate and said cylinder head, said spacer having generally opposite first and second end surfaces, each of said first and second spacer end surfaces respectively abutting an interfacing surface of said valve plate and said cylinder head, said spacer partially defining said discharge chamber, a substantial portion of the volume of said discharge chamber located between said spacer end surfaces;

wherein said first and second spacer end surfaces are each provided with a plurality of substantially concentric ridges having tips, said ridge tips having one of a deformed state and an undeformed state, adjacent ones of said ridges separated by a valley, said ridge tips being placed in said deformed state in response to a compressive load exerted on said spacer between said valve plate and said cylinder head during assembly of said compressor, said deformed ridge tips providing a seal between said first spacer end surface and said valve plate, and between said second spacer end surface and said cylinder head.

2. The compressor assembly of claim 1, wherein said cylinder block and said spacer have substantially similar coefficients of thermal expansion.

3. The compressor assembly of claim 1, wherein said cylinder head and said spacer have substantially similar coefficients of thermal expansion.

4. The compressor assembly of claim 1, wherein said spacer-interfacing surfaces of said cylinder head and said valve plate respectively lie in first and second substantially parallel planes, said spacer extending between third and fourth substantially parallel planes which are substantially parallel to said first plane, said valley of said first and second spacer end surfaces located between said third and fourth planes, and, with said ridge tips in their said undeformed state, said ridge tips of said first and second spacer end surfaces are disposed on sides of said third and fourth planes opposite their respectively adjacent valleys.

5. The compressor assembly of claim 4, wherein said first and third planes, and said second and fourth planes, respectively coincide.

6. The compressor assembly of claim 5, wherein, with said ridge tips in their said deformed state, said ridge tips of said first and second spacer end surfaces lie on said third and fourth planes.

7. The compressor assembly of claim 4, wherein each said valley of one of said first and second spacer end surfaces extend a first distance from the respective one of said third and fourth planes, and said ridge tips of said one of said first and second spacer end surfaces extend a second distance from the said respective one of said third and fourth planes, said first distance greater than said second distance.

8. The compressor assembly of claim 7, wherein said first distance is approximately twice said second distance.

9. A method of assembling a reciprocating piston compressor having a cylinder block with a cylinder bore opening, a valve plate, and a cylinder head, comprising the steps of:

providing a spacer having first and second end surfaces each provided with a plurality of substantially concentric ridges having tips, the ridge tips having one of a deformed state and an undeformed state, adjacent ones of the ridge tips separated by a valley;

orienting the valve plate, the spacer, and the cylinder head in a stacked arrangement over the cylinder bore opening; and exerting a compressive load on the ridge tips to deform the ridge tips to the deformed state, the deformed ridge tips providing sealing contact between the first spacer end surface and the valve plate, and between the second spacer end surface and the cylinder head.

* * * * *